US011702782B2

(12) United States Patent
Hall et al.

(10) Patent No.: US 11,702,782 B2
(45) Date of Patent: Jul. 18, 2023

(54) TUFTING MACHINE AND METHOD OF TUFTING

(71) Applicant: CARD-MONROE CORP., Chattanooga, TN (US)

(72) Inventors: Wilton Hall, Ringgold, GA (US); Ricky E. Mathews, Sale Creek, TN (US)

(73) Assignee: Card-Monroe Corp., Chattanooga, TN (US)

( * ) Notice: Subject to any disclaimer, the term of this patent is extended or adjusted under 35 U.S.C. 154(b) by 27 days.

(21) Appl. No.: 17/541,572

(22) Filed: Dec. 3, 2021

(65) Prior Publication Data

US 2022/0090305 A1 Mar. 24, 2022

Related U.S. Application Data

(63) Continuation of application No. 16/515,098, filed on Jul. 18, 2019, now Pat. No. 11,193,225, which is a (Continued)

(51) Int. Cl.
*D05C 15/30* (2006.01)
*D05C 15/10* (2006.01)

(Continued)

(52) U.S. Cl.
CPC ..... *D05C 15/30* (2013.01); *D05C 11/00* (2013.01); *D05C 15/10* (2013.01); *D05C 15/20* (2013.01);

(Continued)

(58) Field of Classification Search
CPC ..... D05C 15/00–34; D05C 11/00
See application file for complete search history.

(56) References Cited

U.S. PATENT DOCUMENTS 2,423,607 A 7/1947 McCutchen
2,811,244 A 10/1957 MacCaffray, Jr.

(Continued)

FOREIGN PATENT DOCUMENTS

CN 1062562 A 7/1992
CN 1091166 A 8/1994

(Continued)

OTHER PUBLICATIONS

US 9,487,897 B2, 11/2016, Frost et al. (withdrawn)

(Continued)

*Primary Examiner* — Ismael Izaguirre
(74) *Attorney, Agent, or Firm* — Womble Bond Dickinson (US) LLP

(57) ABSTRACT

A tufting machine for selectively forming tufts of yarns, including different color or type yarns, for forming patterned tufted articles such as carpets. A series of needles are reciprocated into and out of a backing material being fed through the tufting machine and are engaged by a series of gauge parts so as to pick-up loops of yarns from the needles. The gauge parts will be selectively controlled by activators to move the gauge parts to positions or elevations sufficient to pick-up or not pick-up loops of yarns from the needles. The feeding of the yarns to the needles further will be controlled to pull back the yarns not picked-up by the gauge parts, while the backing feed will be controlled to enable formation of tufts at an increased rate over the pattern stitch rate for the pattern of the tufted article being formed.

20 Claims, 8 Drawing Sheets

Related U.S. Application Data continuation-in-part of application No. 16/295,114, filed on Mar. 7, 2019, now Pat. No. 10,995,440, which is a continuation of application No. 15/457,036, filed on Mar. 13, 2017, now Pat. No. 10,233,578.

(60) Provisional application No. 62/309,489, filed on Mar. 17, 2016.

(51) Int. Cl.

| | |
|---|---|
| ***D05C 15/20*** | (2006.01) |
| ***D05C 15/22*** | (2006.01) |
| ***D05C 15/24*** | (2006.01) |
| ***D05C 15/26*** | (2006.01) |
| ***D05C 15/34*** | (2006.01) |
| ***D05C 11/00*** | (2006.01) |

(52) U.S. Cl.

CPC ..... *D05C 15/22* (2013.01); *D05C 15/24* (2013.01); *D05C 15/26* (2013.01); *D05C 15/34* (2013.01)

(56) References Cited

U.S. PATENT DOCUMENTS 2,818,037 A 12/1957 McNutt
2,827,866 A 3/1958 Penman
2,840,019 A 6/1958 Beasley
2,842,080 A 7/1958 Hoeselbarth
2,842,259 A 7/1958 Hoeselbarth
2,850,994 A 9/1958 Crawford
2,860,588 A 11/1958 Penman
2,866,424 A 12/1958 Masland, II
2,879,729 A 3/1959 McCutchen
2,882,845 A 4/1959 Hoeselbarth
2,883,735 A 4/1959 Hoeselbarth
2,932,181 A 4/1960 MacCaffray, Jr.
2,965,054 A 12/1960 Masland, II
2,966,866 A 1/1961 Card
2,982,239 A 5/1961 McCutchen
2,982,240 A 5/1961 McCutchen
2,983,028 A 5/1961 Cole
2,985,124 A 5/1961 Rice
2,990,792 A 7/1961 Nowicki et al.
2,991,738 A 7/1961 Zenner et al.
2,968,856 A 12/1961 Allen
3,016,029 A 1/1962 Card
3,026,029 A 1/1962 Card
3,026,830 A 3/1962 Bryant et al.
3,052,198 A 9/1962 Whitney
3,056,364 A 10/1962 Dedmon
3,067,701 A 12/1962 Wilcox
3,075,481 A 1/1963 Stratton
3,084,644 A 4/1963 Card
3,084,645 A 4/1963 Card
3,091,199 A 5/1963 Ballard
3,095,840 A 7/1963 Ballard
3,095,841 A 7/1963 Ballard
3,103,903 A 9/1963 Broadrick et al.
3,108,553 A 10/1963 Beasley
3,108,554 A 10/1963 Payne et al.
3,109,395 A 11/1963 Batty et al.
3,138,126 A 6/1964 Card
3,160,125 A 12/1964 Bryant et al.
3,162,155 A 12/1964 Charles
3,177,833 A 4/1965 Passons
3,202,379 A 8/1965 Dedmon et al.
3,203,379 A 8/1965 Dedmon et al.
3,203,388 A 8/1965 Parlin et al.
3,220,371 A 11/1965 Short et al.
3,229,652 A 1/1966 Ridyard et al.
3,259,088 A 7/1966 Rockholt
3,272,163 A 9/1966 Erwin, Jr. et al.
3,332,379 A 7/1967 Cobble, Sr. et al.
3,361,096 A 1/1968 Watkins
3,375,797 A 4/1968 Gaines
3,386,403 A 6/1968 Short
3,393,654 A 7/1968 Barnes
3,396,687 A 8/1968 Nowicki
3,421,929 A 1/1969 Watkins
3,433,188 A 3/1969 Pickles
3,435,787 A 4/1969 Short
3,485,195 A 12/1969 Torrence
3,490,399 A 1/1970 Hesz
3,511,195 A 5/1970 Hasler et al.
3,547,058 A 12/1970 Wembley et al.
3,554,147 A 1/1971 Spanel
3,577,943 A 5/1971 Watkins
3,585,948 A 6/1971 Cobble
3,605,660 A 9/1971 Short
3,618,542 A 11/1971 Zocher
3,618,543 A 11/1971 Wittier
3,618,544 A 11/1971 Watkins
3,623,440 A 11/1971 Spedding et al.
3,626,878 A 12/1971 Cobble
3,662,697 A 5/1972 Passons et al.
3,670,672 A 6/1972 Spanel et al.
3,688,804 A 9/1972 Brown et al.
3,701,464 A 10/1972 Crum
3,709,173 A 1/1973 Greene
3,735,715 A 5/1973 Passons et al.
3,752,094 A 8/1973 Short
3,752,095 A 8/1973 Brown et al.
3,757,709 A 9/1973 Cobble
3,812,799 A 5/1974 Spanel et al.
3,824,939 A 7/1974 Spanel et al.
3,830,174 A 8/1974 Mellor
3,835,797 A 9/1974 Franks et al.
3,842,767 A 10/1974 Short
3,847,098 A 11/1974 Hammel, Jr.
3,850,120 A 11/1974 Jackson
3,865,059 A 2/1975 Jackson
3,875,883 A 4/1975 Eberwein et al.
3,881,432 A 5/1975 Dodd et al.
3,908,570 A 9/1975 Puckett
3,908,881 A 9/1975 McCann
3,919,952 A 11/1975 Lund
3,919,953 A 11/1975 Card et al.
3,934,524 A 1/1976 Smith
3,937,156 A 2/1976 Spanel
3,937,157 A 2/1976 Spanel et al.
3,937,158 A 2/1976 Spanel
3,937,159 A 2/1976 Spanel
3,937,160 A 2/1976 Spanel et al.
3,943,865 A 3/1976 Short et al.
3,972,295 A 8/1976 Smith
3,978,800 A 9/1976 Card et al.
3,982,491 A 9/1976 Herzer et al.
4,015,550 A 4/1977 Bartenfeld et al.
4,029,030 A 6/1977 Smith
4,047,491 A 9/1977 Spanel et al.
4,048,930 A 9/1977 Card
4,064,816 A 12/1977 Spanel et al.
4,089,281 A 5/1978 Landoni
4,100,863 A 7/1978 Shortte, Jr.
4,103,629 A 8/1978 Card
4,106,416 A 8/1978 Blackstone, Jr. et al.
4,119,047 A 10/1978 Spanel et al.
4,127,078 A 11/1978 Spanel et al.
4,134,347 A 1/1979 Jolley et al.
4,134,348 A 1/1979 Scott
4,138,956 A 2/1979 Parsons
4,154,176 A 5/1979 Spanel et al.
4,155,319 A 5/1979 Short
4,170,949 A 10/1979 Lund
4,173,192 A 11/1979 Schmidt et al.
4,185,569 A 1/1980 Inman
4,193,358 A 3/1980 Woodcock
4,195,580 A 4/1980 Hurst
4,207,825 A 6/1980 Bleasdale
4,221,317 A 9/1980 Fukada et al.
4,224,884 A 9/1980 Shortte, Jr.
4,241,675 A 12/1980 Bardsley
4,241,676 A 12/1980 Parsons et al.

(56) References Cited

U.S. PATENT DOCUMENTS 4,244,309 A 1/1981 Spanel et al.
4,245,574 A 1/1981 Wilson
4,245,794 A 1/1981 Hasegawa et al.
4,254,718 A 3/1981 Spanel et al.
4,255,050 A 3/1981 Beckstein et al.
4,261,498 A 4/1981 Short
4,267,787 A 5/1981 Fukuda
4,285,286 A 8/1981 Hash
4,301,751 A 11/1981 Caylor
4,301,752 A 11/1981 Ingram et al.
4,303,024 A 12/1981 Bardsley
4,303,189 A 12/1981 Wiley et al.
4,313,388 A 2/1982 Biggs et al.
4,317,419 A 3/1982 Spanel et al.
4,320,711 A 3/1982 Slattery
4,353,317 A 10/1982 Crumbliss
4,365,565 A 12/1982 Kawai et al.
4,366,761 A 1/1983 Card
4,369,720 A 1/1983 Beasley
4,370,937 A 2/1983 Denny
4,384,538 A 5/1983 Slattery
4,393,793 A 7/1983 Beasley
4,397,249 A 8/1983 Slattery
4,399,758 A 8/1983 Bagnall
4,401,024 A 8/1983 Frentress
4,419,944 A 12/1983 Passons et al.
4,429,648 A 2/1984 Slattery
4,440,102 A 4/1984 Card et al.
4,445,447 A 5/1984 Bardsley et al.
4,448,137 A 5/1984 Curtis et al.
4,466,366 A 8/1984 Hirotsu
4,469,037 A 9/1984 Bost, Jr.
4,483,260 A 11/1984 Gallant
4,501,212 A 2/1985 Slattery
4,519,332 A 5/1985 Fukuda
4,522,132 A 6/1985 Slattery
4,528,921 A 7/1985 Slattery
4,531,465 A 7/1985 Hampton
4,548,140 A 10/1985 Price et al.
4,549,496 A 10/1985 Kile
4,557,208 A 12/1985 Ingram et al.
4,559,885 A 12/1985 Card et al.
4,562,781 A * 1/1986 Green ..... D05C 15/22
112/80.5
4,574,716 A 3/1986 Czelusniak, Jr.
4,586,445 A 5/1986 Card et al.
4,587,914 A 5/1986 Card et al.
4,597,344 A 7/1986 Stutznacker
4,608,935 A 9/1986 Bardsley
4,619,212 A 10/1986 Card et al.
4,630,558 A 12/1986 Card et al.
4,637,329 A 1/1987 Czelusniak, Jr.
4,653,293 A 3/1987 Porat
4,653,413 A 3/1987 Bagnall
4,658,739 A 4/1987 Watkins
4,665,845 A 5/1987 Card et al.
4,667,611 A 5/1987 Yamamoto et al.
4,669,171 A 6/1987 Card et al.
4,669,403 A 6/1987 Bagnall
4,682,554 A 7/1987 Goto et al.
4,686,918 A 8/1987 Hjalmer et al.
4,688,497 A 8/1987 Card et al.
4,693,190 A 9/1987 Slattery
D293,323 S 12/1987 Slattery et al.
4,726,306 A 2/1988 Crumbliss
4,741,000 A 4/1988 Fukuda
4,786,177 A 11/1988 Beckstein et al.
4,790,252 A 12/1988 Bardsley
4,794,874 A 1/1989 Slattery
4,800,828 A 1/1989 Watkins
4,815,401 A 3/1989 Bagnall
4,815,402 A 3/1989 Price
4,815,403 A 3/1989 Card et al.
4,817,541 A 4/1989 Magourik
4,829,917 A 5/1989 Morgante et al.
4,831,948 A 5/1989 Itoh et al.
4,836,118 A 6/1989 Card et al.
4,840,133 A 6/1989 Watkins
4,841,886 A 6/1989 Watkins
4,849,270 A 7/1989 Evans et al.
4,852,505 A 8/1989 Dedmon
4,856,441 A 8/1989 Kurata
4,860,673 A 8/1989 Ward et al.
4,860,674 A 8/1989 Slattery
4,864,946 A 9/1989 Watkins
4,867,080 A 9/1989 Taylor et al.
4,870,915 A 10/1989 Bagnall
4,890,924 A 1/1990 Beckstein
4,903,624 A 2/1990 Card et al.
4,903,625 A 2/1990 Card et al.
4,981,091 A 1/1991 Taylor et al.
4,991,523 A 2/1991 Ingram
5,005,498 A 4/1991 Taylor et al.
5,035,030 A 7/1991 Pellari
5,042,405 A 8/1991 Bradley
5,058,518 A 10/1991 Card et al.
5,080,028 A 1/1992 Ingram
5,094,178 A 3/1992 Watkins
5,143,003 A 9/1992 Dedmon
5,158,027 A 10/1992 Ingram
5,165,352 A 11/1992 Ingram
5,182,997 A 2/1993 Bardsley
5,189,966 A 3/1993 Satterfield
5,205,229 A 4/1993 Job
5,205,233 A 4/1993 Ingram
5,224,434 A 7/1993 Card et al.
5,267,520 A 12/1993 Ingram
5,295,450 A 3/1994 Neely
5,383,415 A 1/1995 Padgett, III
5,392,723 A 2/1995 Kaju
5,400,727 A 3/1995 Neely
5,413,832 A 5/1995 Willey
5,416,593 A 5/1995 Cercruysse
5,458,075 A 10/1995 Tice et al.
5,461,996 A 10/1995 Kaju
5,480,085 A 1/1996 Smithe et al.
5,484,639 A 1/1996 Woodall et al.
5,491,372 A 2/1996 Erhart
5,495,815 A 3/1996 Bagnall
5,499,588 A 3/1996 Card et al.
5,501,250 A 3/1996 Edwards et al.
5,503,096 A 4/1996 Willey
5,505,150 A 4/1996 James et al.
5,509,364 A 4/1996 Bardsley
5,513,586 A 5/1996 Neely et al.
5,526,760 A 6/1996 Ok
5,529,002 A 6/1996 Piller
5,544,605 A 8/1996 Frost
5,549,064 A 8/1996 Padgett, III
5,557,154 A 9/1996 Erhart
5,560,307 A 10/1996 Padgett, III et al.
5,562,056 A 10/1996 Christman, Jr.
5,566,629 A 10/1996 Satterfield
5,566,630 A 10/1996 Burgess et al.
5,575,228 A 11/1996 Padgett, III et al.
5,588,383 A 12/1996 Davis et al.
5,622,126 A 4/1997 Card et al.
5,645,001 A 7/1997 Green et al.
5,653,184 A 8/1997 Bardsley
5,662,054 A 9/1997 Bardsley
5,706,744 A 1/1998 Card et al.
5,706,745 A 1/1998 Neely et al.
5,738,030 A 4/1998 Ok
5,743,200 A 4/1998 Miller et al.
5,743,201 A 4/1998 Card et al.
5,794,551 A 8/1998 Morrison et al.
5,806,446 A 9/1998 Morrison et al.
5,809,917 A 9/1998 McGowan et al.
5,896,821 A 4/1999 Neely et al.
5,899,152 A 5/1999 Bardsley et al.
5,954,003 A 9/1999 Beyer et al.
5,974,991 A 11/1999 Bardsley
5,979,344 A 11/1999 Christman, Jr.
5,983,815 A 11/1999 Card

(56) References Cited

U.S. PATENT DOCUMENTS

| | | | |
|---|---|---|---|
| 5,989,368 | A | 11/1999 | Tillander et al. |
| 6,009,818 | A | 1/2000 | Card et al. |
| 6,155,187 | A | 12/2000 | Bennett et al. |
| 6,196,145 | B1 | 3/2001 | Burgess |
| 6,202,580 | B1 | 3/2001 | Samilo |
| 6,213,036 | B1 | 4/2001 | Slattery |
| 6,224,203 | B1 | 5/2001 | Wotton et al. |
| 6,228,460 | B1 | 5/2001 | Hamilton et al. |
| 6,230,638 | B1 | 5/2001 | Ownbey et al. |
| 6,244,203 | B1 | 6/2001 | Morgante et al. |
| 6,263,811 | B1 | 7/2001 | Crossley |
| 6,273,011 | B1 | 8/2001 | Amos |
| 6,279,497 | B1 | 8/2001 | Lovelady |
| 6,283,053 | B1 | 9/2001 | Morgante et al. |
| 6,293,211 | B1 | 9/2001 | Samilo |
| 6,401,639 | B1 | 6/2002 | Samilo |
| 6,439,141 | B2 | 8/2002 | Morgante et al. |
| 6,446,566 | B1 | 9/2002 | Bennett et al. |
| 6,502,521 | B2 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,651,571 | B2 | 11/2003 | Bennett et al. |
| 6,729,254 | B2 | 5/2004 | Mamiya |
| 6,758,154 | B2 | 7/2004 | Johnston |
| 6,776,109 | B2 | 8/2004 | Segars et al. |
| 6,782,838 | B1 | 8/2004 | Segars et al. |
| 6,807,917 | B1 | 10/2004 | Christman et al. |
| 6,823,900 | B2 | 11/2004 | Wildeman et al. |
| 6,827,030 | B2 | 12/2004 | Hicks |
| 6,834,601 | B2 | 12/2004 | Card et al. |
| 6,834,602 | B1 | 12/2004 | Hall |
| 6,877,447 | B2 | 4/2005 | Frost et al. |
| 6,877,449 | B2 | 4/2005 | Morgante et al. |
| 6,895,877 | B1 | 5/2005 | Weiner |
| 6,902,789 | B2 | 6/2005 | Funasako |
| 6,945,184 | B2 | 9/2005 | Frost et al. |
| 6,971,326 | B1 | 12/2005 | Clarke et al. |
| 7,007,617 | B2 | 3/2006 | Johnston |
| 7,033,661 | B2 | 4/2006 | Whitten et al. |
| 7,083,841 | B2 | 8/2006 | Oakey et al. |
| 7,089,874 | B2 | 8/2006 | Morgante et al. |
| 7,096,806 | B2 | 8/2006 | Card et al. |
| 7,130,711 | B2 | 10/2006 | Dabrowa et al. |
| 7,216,598 | B1 | 5/2007 | Christman, Jr. |
| 7,222,576 | B2 | 5/2007 | Kilgore |
| 7,237,497 | B2 | 7/2007 | Johnston |
| 7,243,513 | B2 | 7/2007 | Kohlman |
| 7,264,854 | B2 | 9/2007 | Stroppiana |
| 7,296,524 | B2 | 11/2007 | Beverly |
| 7,333,877 | B2 | 2/2008 | Dabrowa et al. |
| 7,347,151 | B1 | 3/2008 | Johnston et al. |
| RE40,194 | E | 4/2008 | Slattery |
| 7,350,443 | B2 | 4/2008 | Oakey et al. |
| 7,356,453 | B2 | 4/2008 | Gould |
| 7,426,895 | B2 | 9/2008 | Smith et al. |
| 7,431,974 | B2 | 10/2008 | Lovelady et al. |
| 7,438,007 | B1 | 10/2008 | Hall |
| 7,478,605 | B2 | 1/2009 | Modra |
| 7,490,566 | B2 | 2/2009 | Hall |
| 7,490,569 | B2 | 2/2009 | Whitten et al. |
| 7,634,326 | B2 | 12/2009 | Christman, Jr. et al. |
| 7,682,686 | B2 | 3/2010 | Curro et al. |
| 7,685,952 | B2 | 3/2010 | Frost et al. |
| 7,707,953 | B2 | 5/2010 | Hillenbrand et al. |
| 7,717,049 | B2 | 5/2010 | Hillenbrand et al. |
| 7,717,051 | B1 | 5/2010 | Hall et al. |
| 7,814,850 | B2 | 10/2010 | Bearden |
| 7,946,233 | B2 | 5/2011 | Hall |
| 8,082,861 | B2 | 12/2011 | Lovelady et al. |
| 8,127,698 | B1 | 3/2012 | Ingram |
| 8,141,505 | B2 | 3/2012 | Hall et al. |
| 8,141,506 | B2 | 3/2012 | Hall et al. |
| 8,240,263 | B1 | 8/2012 | Frost et al. |
| 8,359,989 | B2 | 1/2013 | Hall et al. |
| 8,776,703 | B2 | 7/2014 | Hall et al. |
| 9,139,943 | B2 | 9/2015 | Maddox |
| 9,399,832 | B2 | 7/2016 | Hall et al. |
| 9,410,276 | B2 | 8/2016 | Hall et al. |
| 9,556,548 | B2 | 1/2017 | Frost et al. |
| 9,657,419 | B2 | 5/2017 | Hall |
| 9,677,210 | B2 | 6/2017 | Hall et al. |
| 9,708,739 | B2 | 7/2017 | Hall |
| 10,233,578 | B2 | 3/2019 | Hall |
| 10,280,541 | B2 | 5/2019 | Mathews |
| 10,995,440 | B2 | 5/2021 | Hall et al. |
| 11,193,225 | B2 | 12/2021 | Hall et al. |
| 2002/0037388 | A1 | 3/2002 | Morgante et al. |
| 2002/0067483 | A1 | 6/2002 | Lacovara |
| 2003/0164130 | A1 | 9/2003 | Morgante et al. |
| 2004/0025767 | A1 | 2/2004 | Card et al. |
| 2004/0187268 | A1 | 9/2004 | Johnston |
| 2004/0253409 | A1 | 12/2004 | Whitten et al. |
| 2005/0056197 | A1 | 3/2005 | Card et al. |
| 2005/0109253 | A1 | 5/2005 | Johnston |
| 2005/0188905 | A1 | 9/2005 | Dabrawa et al. |
| 2005/0204975 | A1 | 9/2005 | Card et al. |
| 2006/0272564 | A1 | 12/2006 | Card et al. |
| 2007/0272137 | A1 | 11/2007 | Christman et al. |
| 2008/0134949 | A1 | 6/2008 | Bearden |
| 2009/0056606 | A1 | 3/2009 | Lovelady et al. |
| 2009/0205547 | A1 | 8/2009 | Hall et al. |
| 2009/0260554 | A1 | 10/2009 | Hall et al. |
| 2010/0132601 | A1 | 6/2010 | Nakagawa et al. |
| 2013/0180440 | A1 | 7/2013 | Hall |
| 2014/0000497 | A1 | 1/2014 | Modra |
| 2014/0272260 | A1 | 9/2014 | Weiner et al. |
| 2014/0283724 | A1 | 9/2014 | Frost et al. |
| 2014/0311392 | A1 | 10/2014 | Hall et al. |
| 2014/0331906 | A1 | 11/2014 | Hall |
| 2016/0003251 | A1 | 2/2016 | Hall et al. |
| 2016/0289880 | A1 | 10/2016 | Hall |
| 2017/0268144 | A1 | 9/2017 | Hall |
| 2021/0246589 | A1 | 8/2021 | Hall |

FOREIGN PATENT DOCUMENTS

| | | | |
|---|---|---|---|
| CN | 1139964 | A | 1/1997 |
| CN | 1410615 | A | 4/2003 |
| CN | 1619041 | A | 5/2005 |
| CN | 1744988 | A | 3/2006 |
| CN | 1946893 | A | 4/2007 |
| CN | 101024912 | A | 8/2007 |
| CN | 101988235 | A | 3/2011 |
| CN | 102144059 | A | 8/2011 |
| CN | 102535058 | A | 7/2012 |
| CN | 208933643 | U | 6/2019 |
| EP | 0581744 | A2 | 2/1994 |
| EP | 483 390 | B1 | 5/1995 |
| EP | 1 474 354 | B1 | 7/2010 |
| EP | 2 100 994 | B1 | 6/2011 |
| EP | 3 805 441 | A1 | 4/2021 |
| GB | 853 943 | | 11/1960 |
| GB | 859 761 | | 1/1961 |
| GB | 920 023 | | 3/1963 |
| GB | 932625 | A | 7/1963 |
| GB | 1 039 857 | | 8/1966 |
| GB | 1058173 | A | 2/1967 |
| GB | 1245103 | A | 9/1971 |
| GB | 1507201 | A | 4/1978 |
| GB | 2 050 447 | | 7/1981 |
| GB | 2 115 025 | | 9/1983 |
| GB | 2161840 | A | 1/1986 |
| GB | 2204884 | A | 11/1988 |
| GB | 2205864 | A | 12/1988 |
| GB | 2 246 371 | | 1/1992 |
| GB | 2262946 | A | 7/1993 |
| GB | 2 319 786 | | 6/1998 |
| GB | 2 357 519 | | 6/2001 |
| GB | 2 392 172 | | 2/2004 |
| GB | 2 385 604 | | 3/2005 |
| GB | 2 446 371 | | 8/2008 |
| JP | 1-221563 | | 9/1989 |
| JP | 03-294561 | | 12/1991 |

(56) References Cited

FOREIGN PATENT DOCUMENTS

| | | | |
|---|---|---|---|
| JP | 6-83787 | | 11/1994 |
| JP | 08-003859 | | 1/1996 |
| JP | 11-217763 | | 8/1999 |
| JP | 2005-179801 | | 7/2005 |
| JP | 2005-240199 | | 9/2005 |
| JP | 2006-524753 | | 11/2006 |
| JP | 2011-526970 | | 10/2011 |
| WO | WO 84/00388 | | 2/1984 |
| WO | WO 94/28225 | A1 | 12/1994 |
| WO | WO 96/12843 | | 5/1996 |
| WO | WO 00/055412 | A1 | 9/2000 |
| WO | WO 01/20069 | A1 | 3/2001 |
| WO | WO 01/059195 | A2 | 8/2001 |
| WO | WO 02/077351 | | 10/2002 |
| WO | WO 2004/057084 | A2 | 7/2004 |
| WO | WO 2006/076558 | A1 | 7/2006 |
| WO | WO 2019/115317 | A1 | 6/2019 |

OTHER PUBLICATIONS

Partial European Search Report dated Jul. 7, 2015, for related application No. EP 14 16 7507.4.
International Search Report with Written Opinion dated Jul. 19, 2017, for related application No. PCT/US2017/022689.
Tuft Program, Version 1.20, Nov. 1993, NedGraphics BV.
Carpet Design, Technology Are on a Roll, Kathryn Sellers, Carpet & Rug Institute, .COPYRGT.2001, Textile World, vol. 151, No. 3.
NedGraphics, Aug. 26, 1994, Carpet & Floor Coverings Review.
Partial European Search Report for EP 14 16 7507 dated Mar. 18, 2015.
Cobble, ST (with Graphical User Interface) Tufting Machine-Operator's Handbook—Revision 1.5, Software Build 43—Issue Date: Sep. 2003.
Office Action for JP 2013-211615, dated Aug. 22, 2014, with English translation.
Petition for Inter Partes Review Under 35 USC .sctn..sctn. 311-319 and CFR .sctn. 42.100 et seq, filed in Patent Trial and Appeal Board in the matter of *Tuftco Corp.* v. *Card-Monroe Corp*, on Dec. 24, 2014, Inter Partes Review No. IPR2015-00505.
Cobble Tufting Machine Company, Inc. ColorTec Operating and Maintenance Manual Servotec Software Version 3.10.xx Apr. 2005.
Spare Parts Manual ColorTec, dated 05-8, 1998.
Windows PCCI Operator's Manual, Version 1.0, dated Mar. 13, 1998.
Command Performance 2000 Instruction Manual, Version 3.12, CMC #801107-01, Card-Monroe Corp., Copyright 1985-1994, Chattanooga, TN.
Notification and International Preliminary Report on Patentability for PCT/US2017/022689 dated Sep. 27, 2018.
Extended European Search Report for related application, EP 17 767 520.4-1018 / 3430189 PCT/US2017022689 dated Sep. 9, 2019.
Notice of Reasons for Rejection in the Japanese Patent Application No. 2018-54844 with English Translations dated Nov. 19, 2019.
Extended European Search Report for related application, EP 20210621.7, dated Dec. 23, 2020.

* cited by examiner

TUFTING MACHINE AND METHOD OF TUFTING

CROSS REFERENCE TO RELATED APPLICATIONS

The present application is a continuation of U.S. patent application Ser. No. 16/515,098 filed Jul. 18, 2019, which is a continuation-in-part of U.S. patent application Ser. No. 16/295,114, filed Mar. 7, 2019, which is a continuation of U.S. patent application Ser. No. 15/457,036, filed Mar. 13, 2017, which further claims priority to U.S. patent application Ser. No. Provisional Application Ser. No. 62/309,489, filed Mar. 17, 2016. This Patent Application claims the benefit of the foregoing recited United States Patent Applications and United States Provisional Application according to the statutes and rules governing such applications, including 35 U.S.C. §119(6), and 37 CFR §§ 1.78(a)(3) and 1.78(a)(4).

INCORPORATION BY REFERENCE

The disclosures of each of the above-referenced U.S. patent application Ser. No. 16/515,098, filed Jul. 18, 2019, U.S. patent application Ser. No.16/295,114, filed Mar. 7, 2019, U.S. patent application Ser. No.15/457,036, filed Mar. 13, 2017, and U.S. Provisional Patent Application No. 62/309,489, which was filed on Mar. 17, 2016, are hereby incorporated by reference for all purposes as if presented herein in their entireties.

FIELD OF THE INVENTION

The present disclosure generally relates to tufting machines and methods of forming tufted fabrics. In particular, the present invention relates to tufting machines including selectively controllable gauge parts, such as loopers, and methods of forming patterned tufted fabrics, such as carpets, having enhanced control of the placement and formation of stitches or tufts within the pattern.

BACKGROUND OF THE INVENTION

In the tufting field, particularly with regard to commercial and hospitality carpets, there has been increased demand for the production of carpets and rugs with new visual patterns, including the use of multiple different colors, in an effort to keep up with changing consumer tastes and increased competition in the marketplace. Carpet designers and manufacturers thus have placed increased emphasis on the creation of newer, different and more eye-catching patterns for carpets, rugs and other tufted fabrics, including patterns having the selective placement and display of yarns of particular colors or types within pattern fields thereof, and with the resultant tufted fabrics being formed with a substantially true pattern density of the visible tufts of the pattern. In particular, it has been desirable to try to replicate as closely as possible the look and feel of patterned carpets, rugs or other fabrics formed on a loom, but which can be created and formed therein on broadloom tufting machines so as to enable increased efficiencies in production of such patterned tufted carpets, rugs and/or other fabrics.

Accordingly, it can be seen that a need exists for a system and method of forming tufted fabrics such as carpets and rugs that addresses these and other related and unrelated problems in the art.

SUMMARY OF THE INVENTION

Briefly described, the present invention generally relates to a tufting machine and method of forming patterned tufted articles in which the placement and the pile height of tufts of yarns or stitches formed in a backing can be selectively controlled so as to enable formation of patterned tufted articles, such as carpets, having a variety of pattern effects, including the formation of tufted articles with free-flowing multi-color and/or multi-pile height patterns, as well as having substantially woven or loom formed appearances. The tufting machine of the present invention typically will include a control system for controlling the operative elements of the tufting machine to form or create desired input, programmed, scanned and/or designed patterns. The resultant patterned tufted articles can include various pattern effects, including having multiple, varied or different pile heights, different types of tufts in the same and/or varying tuft rows, and other textured effects, as well as the placement of various color and/or type yarns to be visible at selected locations and pile heights across the backing, with the resultant tufted article being provided with a density of retained and/or visible color yarns/stitches per inch that substantially matches a desired or prescribed pattern density or stitches per inch for the pattern being formed/tufted.

The tufting machine will include one or more needle bars having a series of needles mounted therealong, with a tufting zone defined along the path of reciprocation of the needles. A backing material is fed through the tufting zone and tufts of yarns will be introduced therein as the needles are reciprocated into and out of the backing material. A shift mechanism further can be provided for shifting the needle bar(s) transversely across the tufting zone, and multiple shift mechanisms can be utilized where the tufting machine includes more than one shifting needle bar. The shift mechanism(s) generally will be operable in response to control instructions from the control system and can comprise servo motor controlled shifters, one or more cams, or other shifters, such as a "SmartStep" shift mechanism as manufactured by Card-Monroe Corp., for stepping or shifting the needle bar(s) transversely across the backing in accordance with programmed and/or designed pattern shift steps for a pattern being tufted.

The tufting machine further generally will include at least one yarn feed mechanism or pattern attachment for controlling the feeding of the yarns to their respective needles. Such a pattern yarn feed pattern attachment or mechanism can include various roll, scroll, servo-scroll, single end, double or multiple end yarn feed attachments, such as, for example, a Yarntronics™ or Infinity IIE™ yarn feed attachment as manufactured by Card-Monroe Corp. Other types of yarn feed control mechanisms also can be used. The at least one yarn feed mechanism or pattern attachment can be operated to selectively control the feeding of the yarns to their selected needles according to the pattern instructions for forming tufts of yarns, including tufts having varying pile heights, to create the desired carpet pattern appearance.

In other embodiments, the control system can further comprise or operate with a stitch distribution control system, such as disclosed in U.S. Pat. No. 8,359,989 (the disclosure of which is incorporated by reference as if set forth fully herein), and can control the at least one yarn feed mechanism such that the yarns to be shown on the face or surface of the tufted article generally can be fed in amounts sufficient to form tufts of desired heights while the non-appearing yarns, which are not to be shown in the tufted field, will be back-robbed or otherwise pulled sufficiently low and/or out of the backing; and/or can be controlled to move or stay with selected needles as the selected needles are reciprocated into and out of the backing and are not engaged by a looper or other gauge part, as so as to avoid creation of undesired gaps or spaces between and/or minimize interference with the face or retained, visible tufts of yarns of the pattern. For each pixel or stitch location of the pattern, a series of yarns generally can be presented, and yarns not selected to be visible or appearing at such a stitch location can be pulled sufficiently low to be hidden and not interfere with the selected yarns to be visible, and/or removed. Thus, only the desired or selected yarns/colors to be placed at a particular stitch location typically will be retained at such stitch location, while the remaining yarns/colors can be hidden in the pattern fields being sewn at that time, including the yarns being removed or pulled out of the backing and floating on the surface of the backing material. The control system further will control the coordinated operation of the shift mechanism(s), yarn feed mechanism(s) and gauge part assembly to control selective formation of loops and/or tufts of yarns, and the lengths or pile heights thereof, according to the instructions for the pattern being formed.

The gauge part assembly will comprise a series of gauge parts, which, in one embodiment, can include level cut loopers or hooks, loop pile loopers, or other gauge parts, provided below the tufting zone, and reciprocated into engagement with the needles as the needles penetrate the backing material to pick loops of yarns therefrom. The gauge parts further each can be selectively movable in a direction that is generally normal or perpendicular to their direction of reciprocation, for example, being moved in a substantially vertical, i.e., up-and-down, motion with respect to the stroke or reciprocation of the needles into and out of the backing, and which also is generally normal or perpendicular to the reciprocating motion of the gauge parts toward and away from the needles, to selectively pick up and form loops of yarns in the backing material. In addition, the vertical movement of the gauge parts can be controlled so as to form varying loops of yarns of varying pile heights in the backing material, including formation of different pile height loops or even no loops of yarns in the backing. In still further embodiments, other configurations and/or combinations of loop pile loopers, cut pile hooks, cut/loop looks, level cut loopers or hooks, and/or other gauge parts also can be used.

In one embodiment, the gauge parts can include level cut loopers or hooks, loop pile loopers, hooks, or other gauge parts, each having an elongated body, lower or first portion slidably mounted within a module or gauge block, and a second, upper or hooked portion, which can include an elongated throat extending at an angle with respect to the body portion, and terminating at a pointed proximal end or bill. The lower or distal end of the body can extend through a gauge block or module and can be connected to an actuator. The actuators can comprise hydraulic, air or pneumatic cylinders, motors, solenoids, electrical actuators or drives, or other, similar actuators. The actuators of each of the gauge parts can be selectively controlled in accordance with pattern instructions so as to cause the gauge parts to be raised or retracted to a desired vertical position with respect to associated needles for pickup of loops of yarns from the needles, including extended positions for picking up loops of yarns at selected point along the needles' stroke so as to form loops/tufts, as well as being retracted to a "no-sew" position wherein a loop of yarn generally will not be picked up. The gauge parts also could be moved to different elevations or heights to pick up loops from the needles to form different length loops or tufts of varying pile heights.

In a further embodiment or operation, the actuators can be controlled/triggered to operate and retract or lower their gauge parts with a loop of yarn captured thereon so as to elongate or pull such captured loop(s) lower to create even higher piles and/or other effects, such as for tip shearing or other, additional pattern texture effects. For example, the gauge parts can engage and pick loops of yarns from selected needles and thereafter can be moved, e.g. retracted, to a lower position, with the feeding of the yarns for such loops also being controlled, so as to draw or pull the loops to a lowered or extended length position to create varying pile height effects.

The level cut loop loopers or hooks additionally will be arranged so as to engage the needles, including being arranged in a substantially in-line, offset or staggered, and/or other configurations as needed to engage in-line, staggered and/or dual needle bar arrangements. Each of the level cut loop loopers or hooks further can be arranged at an angle with respect to the needles as the needles penetrate the backing. For example, in some embodiments, the level cut loop loopers or hooks, loop pile loopers or other gauge parts can be arranged and/or be extensible/retractable along a path of travel oriented at an angle that can range from approximately 1° degree to approximately 10° from the vertical with respect to the needles and/or the stroke or vertical motion thereof, while in other arrangements, no offset, i.e., a 0° angle, can be provided between the level cut loop loopers or hooks and the needles. The offset of the gauge parts with respect to the needles can be further varied so that the gauge parts can be extended and retracted along an angled or offset path of travel with respect to the needles as needed to minimize potential engagement of the gauge parts by the needles as the gauge parts are being retracted, depending upon the spacing and/or arrangement of the needles.

In operation of the tufting machine and method according to one example embodiment of the present invention, as the needles are reciprocated into and out of the backing, the actuators of the level cut loop loopers or hooks, loop pile loopers or other gauge parts can be selectively engaged or disengaged so as to move their gauge parts between a fully retracted or no-sew position at which such a gauge part will not engage an associated or corresponding needle, and thus no loop of yarn will be formed thereby, and varying extended or raised positions, including a fully extended position. In their raised or extended positions, the gauge parts can engage the needles as the needles pass into and out of the backing material, to pick-up and pull loops of yarns from the needles. The loops of yarns picked up from the needles can have varying pile heights or lengths depending upon the position of the level cut loop loopers or hooks with respect to their associated or corresponding needles. For example, in a fully raised position, a loop of yarn of a desired length can be formed for creating a tuft of a selected pile height. The lengths of the loops of yarns further can be varied by control of the positons and/or movement of the gauge parts and yarn feed control to form varying height loops, even substantially hidden loops of yarns in the backing, including loops being substantially removed by control of the yarn feed thereof. In a no-sew position, the gauge parts may not pick up loops of yarns, and the yarn feed can be controlled to maintain the yarns with the needles as the needles reciprocate into and out of the backing material, to potentially avoid formation of a loop of yarn where not needed or desired.

As an alternative, longer loops of yarns can be picked up and formed by loopers presented at lowered positions, so as to create higher or greater pile height tufts of yarns in the backing. In addition, and/or as a further alternative, the actuators further can be controlled to selectively cause their corresponding gauge parts to be lowered or retracted with a loop of yarn captured thereon, to form still longer loops of yarns to enable additional patterning effects, such as varying pile heights, texturing effects, for tip shearing, and other pattern effects.

The needles further generally can be shifted laterally with respect to the longitudinal movement of the backing through the tufting zone in order to present different color or different type yarns to each stitch location of the pattern being formed in the backing material. For example, the needles of the needle bar or bars can be threaded with a series of desired colors in various thread-up sequences. In addition, the backing material typically can be run at an actual or effective stitch rate that is substantially greater than the prescribed or desired pattern stitch rate for the pattern being formed. As a result, as the needles are shifted, a desired number of different color or type yarns can be presented to each stitch location, and by control of the extension and/or retraction of the level cut loop loopers or hooks, loops of yarns can be selectively formed in the backing material, and with the formation of such loops of yarns further being controlled for varying pile heights of the resultant tufts. For example, a series of different color or type yarns can be presented to each stitch location as the needle bars are shifted, and if a tuft of a particular color or type yarn is not selected to be sewn at that stitch location, the corresponding level cut loop looper or hook can be held in a retracted or lowered position such that the loop of such a non-selected yarn generally will not be formed.

In addition, as the needles are reciprocated out of the backing, the yarn feed therefor also can be controlled so as to cause non-selected yarns to be retracted, back-robbed or otherwise pulled back and/or out of the backing material with the needles, and to retract, back-rob or pull back some loops of yarns to an extent sufficient to prevent such yarn from being shown at that stitch location in the finished patterned article. For example, where selected gauge parts are moved into their no-sew positions and thus do not pick-up a loop of yarn from a corresponding needle, the yarns carried by such needles can be controlled so as to be maintained with their needles, being carried into and out of the backing with the needles. As a further result, such yarns can be protected from becoming twisted or otherwise affected by the backing as can occur when formed loops of yarns are pulled back or out of the backing material. The control of the backing material at the higher operative, effective or actual stitch rate enables the formation of a substantially increased number of stitches of presentations of yarns into the backing material so as to substantially avoid a missing color or type of yarn or gap being created, shown or otherwise appearing in the pattern fields of the patterned tufted article. The finished patterned tufted article thus can be provided with a density of tufts per inch that substantially matches a desired or prescribed pattern stitch rate, i.e., for patterns designed with a pattern stitch rate of 8, 10 or 12, or other numbers of stitches per inch, the resultant finished patterned tufted article can be formed a density of visible and/or retained face yarns or tufts per inch that can approximately match the pattern stitch rate.

In another aspect of the tufting machine and method of forming patterned tufted articles, the gauge parts can be configured to move or pivot between raised, operative positions, including a fully raised, first operative position, and a lowered, no-sew position, with a distal end or tip of the gauge parts generally being oriented and/or arranged below a penetration depth or lowest point of the stroke of the needles. The gauge parts can comprise loopers, hooks, level cut loop loopers, or other gauge parts, with a body pivotally mounted to a support or holder, and with a throat projecting forwardly from the body and terminating at the generally pointed tip or distal end. Actuators, such as cylinders, solenoids, motors, or other, similar actuators/drives will be coupled to the body of each of the gauge parts, at a proximal end thereof. The actuators can be selectively engaged or operated so as to cause the body of their corresponding or associated gauge part to be pivoted, moving the throats and distal ends of the gauge parts to a desired lowered elevation with respect to the needles.

The gauge parts further are reciprocated toward and away from the needles, engaging the needles and picking loops of yarns therefrom to form tufts of desired or selected pile heights when in an operative position. When in their lowered, no-sew position, the gauge parts generally will not pick up loops of yarns from their needles. The yarn feed further will be controlled to backrob and/or pull selected yarns substantially low or out of the backing, including controlling the yarns fed to each needle where an associated gauge part is in its lowered, no-sew position such that when a loop of yarn is not picked from such a needle, the feeding of such yarns will be controlled to substantially maintain such yarns with their needles as the needles are reciprocated into and out of the backing material.

Various objects, features and advantages of the present invention will become apparent to those skilled in the art upon a review of the following detail description, when taken in conjunction with the accompanying drawings.

Figure 1:
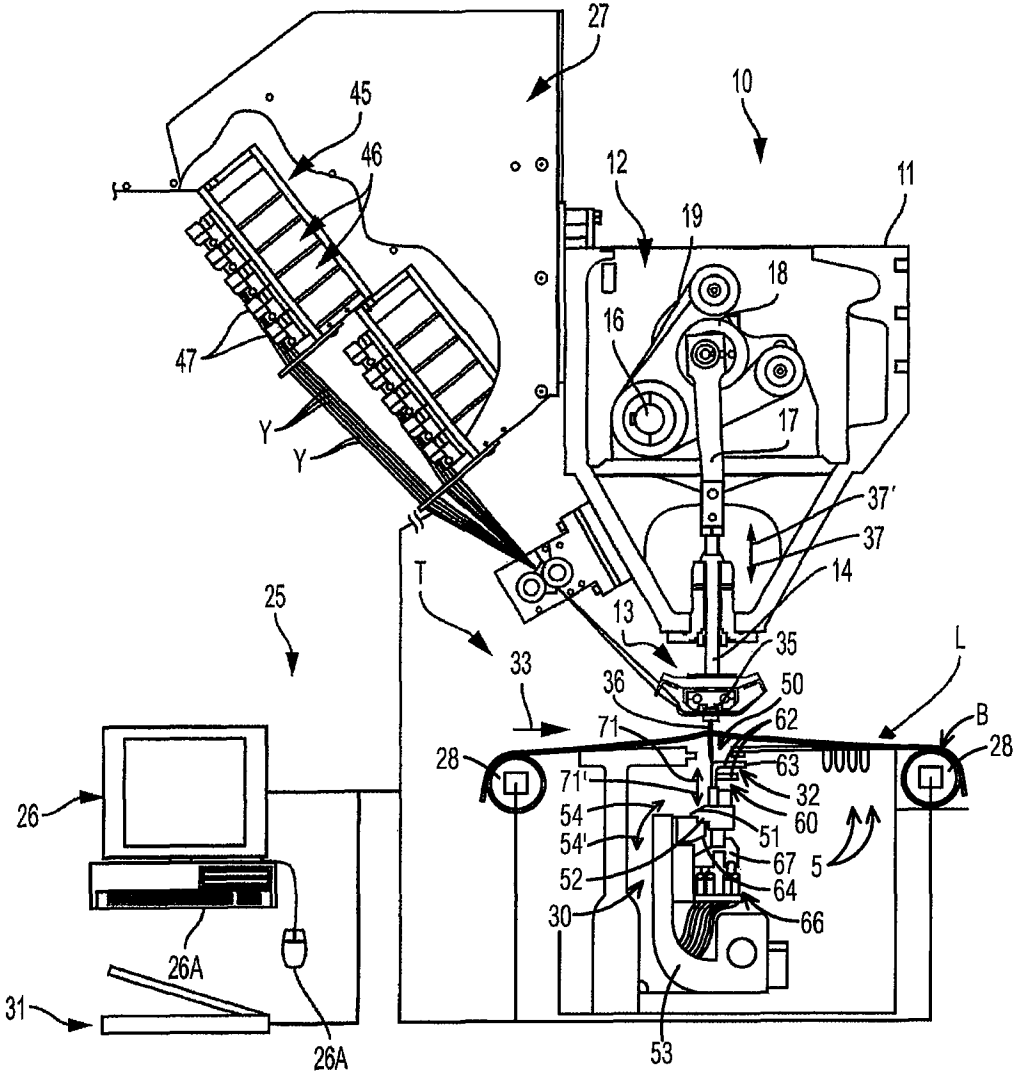
FIG. 1 is a side elevational view of one example embodiment of a tufting machine with selectively controllable looper assembly according to the principles of the present invention.

Those skilled in the art will appreciate and understand that, according to common practice, the various features of the drawings discussed below are not necessarily drawn to scale, and that the dimensions of various features and elements of the drawings may be expanded or reduced to more clearly illustrate the embodiments of the present invention described herein.

DETAILED DESCRIPTION OF THE INVENTION

Referring now to the drawings in which like numerals indicate like parts throughout the several views, FIGS. 1-7B generally illustrate various aspects and embodiments of a tufting machine 10 and method for forming patterned tufted articles, according to the principles of the present invention, wherein placement of stitches or tufts 5 of yarns Y can be at desired locations in a backing material B can be controlled. Such tufts or stitches can be formed with a sculptured, multi-pile height tufted appearance, and further can be placed with enhanced selectivity and/or control, for formation of further varying or free-flowing pattern effects. For example, the tufted article can be formed with the tufts of yarns formed at varying pile heights to provide sculptured looks, and with different color or type yarns for formation of multi-color patterns of various geometric and/or free-flowing designs. Additionally, it will be understood that various numbers of different type and/or color yarns (i.e., two color, three color, five color, six color, etc.), can be used to form multiple pile height patterned tufted articles according to the principles of the present invention.

As generally illustrated in FIG. 1, in one embodiment, the tufting machine 10 will include a frame 11, which can include a head or upper portion 12 housing a needle bar drive 13 and defining a tufting zone T. The needle bar drive mechanism 13 (FIGS. 1 and 2) typically includes a series of push rods 14 that can be connected to a needle bar drive 16 (such as a gear box/assembly) shown in FIG. 1 or similar mechanism, by connector rods 17, which needle bar drive 16 in turn can be connected to and driven off a main drive shaft 18 of the tufting machine, for example by one or more drive belts or drive chains 19, and with the main drive shaft 18 itself being driven by a motor such as a servo motor. Alternatively, the push rods 14 of the needle bar drive mechanism 13 can be connected via connector rods 17 to the main drive shaft 18 so as to be driven directly off the main drive shaft, or by an independent drive system (not shown).

An encoder or similar sensor additionally can be provided for monitoring the rotation of the main drive shaft and reporting the position of the main drive shaft to a control system 25 (FIG. 1) controlling the operation of the tufting machine 10. The control system 25 generally can comprise a tufting machine control including a computer/processor or system controller 26 with an operator interface 26A, such as a touch screen, keyboard, mouse, etc., through which the operator can input patterns, make adjustments, etc. In some embodiments, the control system 25 can comprise or include a stitch distribution control system such as disclosed in U.S. Pat. No. 8,359,989, the disclosure of which is incorporated by reference as if set forth fully herein, with the controller 26 further including programming for control methodology for forming tufted patterns, including sculptured patterns having tufts formed at multiple pile heights, as well as with various color/stitch placement controlled patterns such as disclosed in U.S. Pat. No. 8,359,989.

Figure 2:
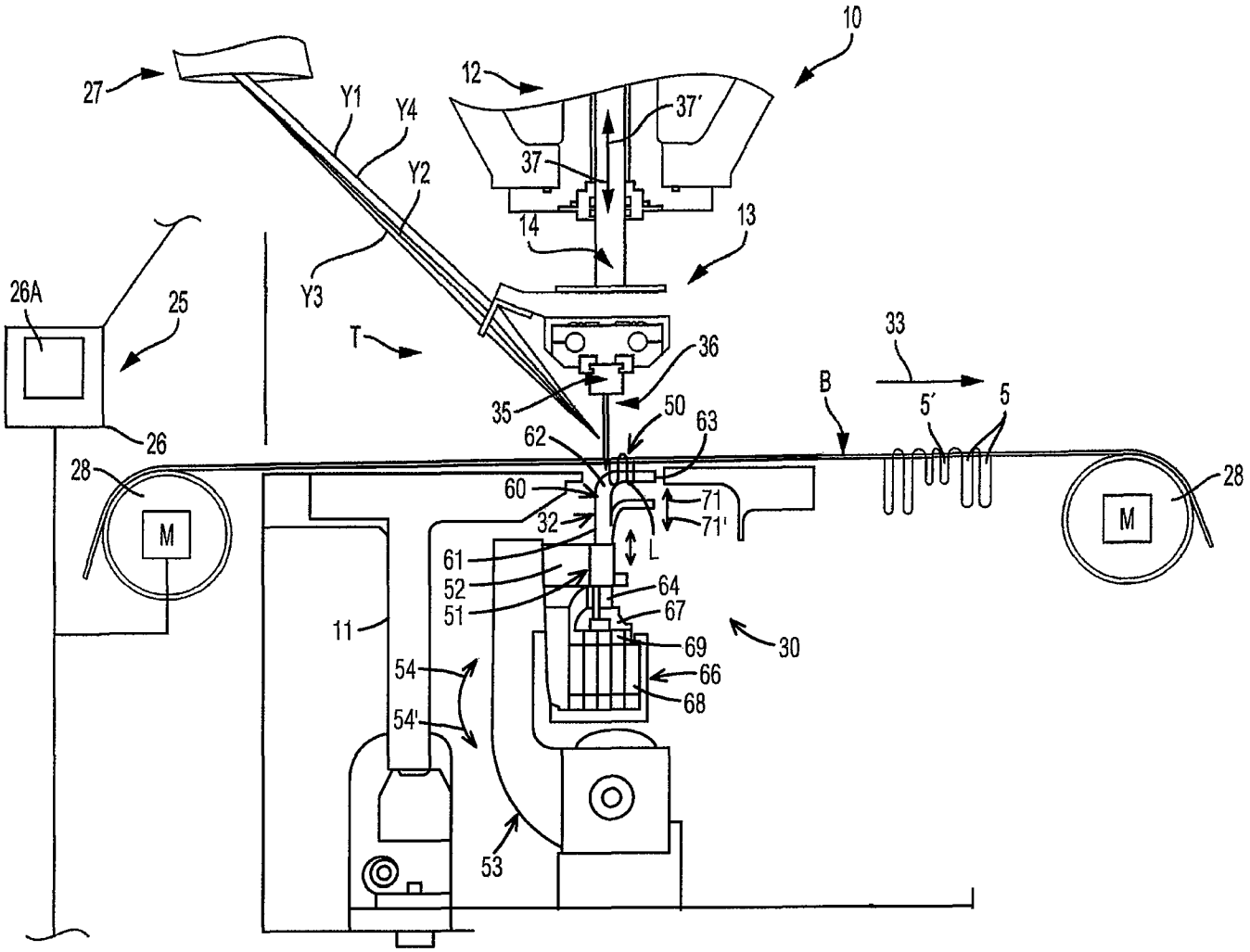
FIG. 2 is a side elevational view of the tufting zone of the tufting machine of FIG. 1.
Figure 3:
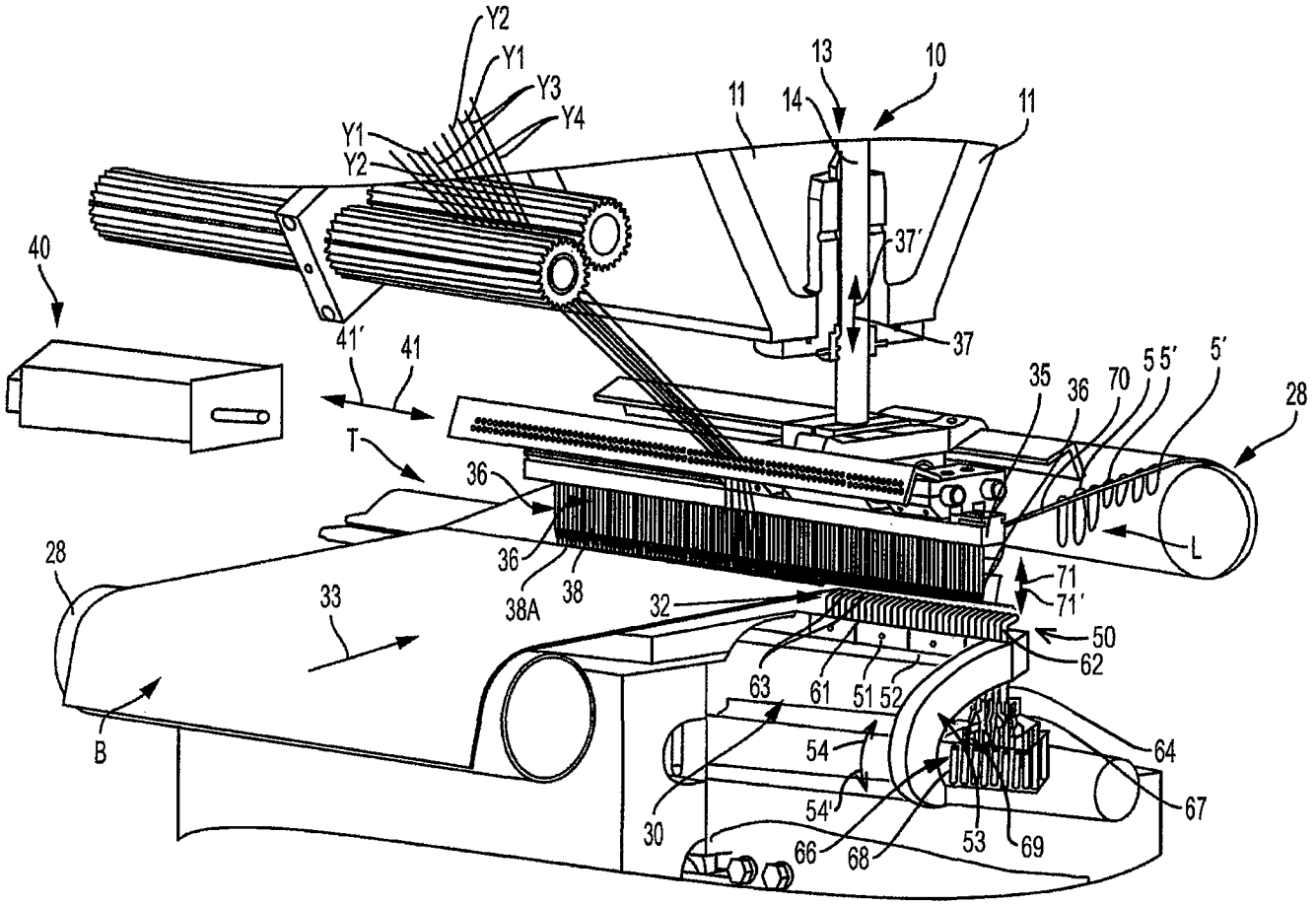
FIG. 3 is a perspective view of the tufting machine of FIGS. 1-2.

The control system 25 generally will include programming enabling the monitoring and control of the operative elements of the tufting machine 10, such as the needle bar drive mechanism 13, yarn feed attachments 27, backing feed rolls 28, the main drive shaft 18, a needle bar shift mechanism 40 (FIG. 3) and a gauge part assembly 30 mounted beneath the tufting zone T of the tufting machine in accordance with the calculated/determined pattern instructions, as discussed more fully below. The control system 25 (FIG. 1) further can receive and execute or store pattern information in memory storage of the system controller 26. In response to developed/programmed pattern instructions, the control system 25 will control the operative elements of the tufting machine 10 in order to form the desired tufted patterns in the backing material B as the backing material is passed through the tufting zone T in the direction of arrow 33 by the backing feed rolls 28, as indicated in FIGS. 1-3.

In some embodiments, the system controller 26 of the control system 25 generally can be programmed with instructions for forming one or more desired patterns for one or more tufted articles, including a series of pattern steps, which steps can be created or calculated manually or through the use of design centers or design software as understood by those skilled in the art or can receive such patterns via input from a disk, USB or other external drive, or through a network connection. Alternatively, the controller 26 can include image recognition software to enable scanned and/or designed pattern images, such as designed patterns, including pile heights and other characteristics such as placement of loop pile and cut pile tufts in the pattern shown by, for example, different colors or similar markers or indicators, as well as photographs, drawings and other images, can be input, programmed, recognized and processed by the control system, including receiving inputs from a design center or through various design software systems, or via a scanner or other imaging device 31 (FIG. 1). The control system can recognize and identify various pattern characteristics, including colors and/or difference in texture of a designed pattern image indicative of texture effects such as placement or location of loop and/or cut pile tufts, and can assign selected yarns thereto.

Additionally, in embodiments such as where the control system 25 operates with or comprises or includes functionality of a stitch distribution control system, as disclosed in U.S. Pat. No. 8,359,989 (incorporated by reference as if set forth fully herein), the control system also can be provided with software/programming to read and recognize colors of an input scanned pattern, and can assign supply positions for the yarns being supplied from a supply creel to various ones of the needles based on the thread-up sequence of the needles of the needle bar so as to optimize the supplies of the various color yarns in the creel for the best use thereof, to form recognized pattern fields from pattern images. The system control further can create pattern fields or mapping of the pattern, including a series of pattern pixels or tuft/stitch placement locations identifying the spaces or locations at which the various color yarns and/or cut/loop pile tufts will be selectively placed to form the imaged pattern. A desired pattern density, i.e., a desired number of stitches per inch to appear on the face of the finished patterned tufted article, also can be selected and an actual effective or operative process stitch rate for the pattern calculated to achieve the appearance of the desired fabric stitch rate of the pattern.

The control system 25 of the invention further can include programming to receive, determine and/or execute various shift or cam profiles, or can calculate a proposed shift profile based on a scanned, an input, or other designed pattern image or pattern file. Effectively, in one embodiment, a designed pattern file image, photograph, drawing, etc., can be loaded, scanned, or otherwise input at the tufting machine or by a network connection, and the control system can read, recognize and calculate the pattern steps/parameters, including control of yarn feed, control of backing movement and/or needle reciprocation to form tufts in the backing at an effective stitch rate to achieve a desired pattern density, a cam/shift profile, and arrangement of yarns to match the scanned and/or designed pattern image, and can thereafter control the operation of the tufting machine to form this selected pattern. An operator additionally can select or modify stitch rates, yarn feeds, a selected cam profile or a calculated shift profile, such as by indicating whether the pattern is to have 2, 3, 4, 5, 6 or more colors, or a desired number of pattern repeats, and/or can manually calculate, input and/or adjust or change the creel assignments, shift profiles and/or a color mapping created by the control system as needed via a manual override control/programming.

As indicated in FIGS. 1-3, the tufting machine 10 further will include one or more needle bars 35 attached to and driven by the push rods 14. The needle bar(s) 35 move a series of needles 36 in a reciprocating motion (shown by arrows 37/37') into and out of the backing material B, so as to carry or insert the yarns Y into the backing. In some embodiments, the needles can be arranged in a single in-line row along one or two needle bars. In other embodiments, the needles 36 can be mounted in a staggered arrangement along a single needle bar or along a pair of needle bars, with offset rows of needles spaced transversely along the length of each needle bar(s) and being staggered across the tufting zone of the tufting machine. The needle bar(s) 35 further can be shiftable transversely across the width of the backing material, so as to shift or step the needles 36 in a direction that is transverse or generally perpendicular to the longitudinal path of travel through the tufting machine. Accordingly, while one example embodiment including a single needle bar 35, with an inline row of needles 36 arranged therealong may be shown in the figures, the present invention is not limited to the use of a single needle bar or a particular configuration of needles. Instead, it will be understood by those skilled in the art that additional arrangements of dual needle bars and single needle bars having spaced rows of needles 36 that can be arranged in-line or in staggered or offset configurations, and both of which further can be shifted, also can be utilized in the tufting machine 10 incorporating the system according to the present invention.

Figure 4A:
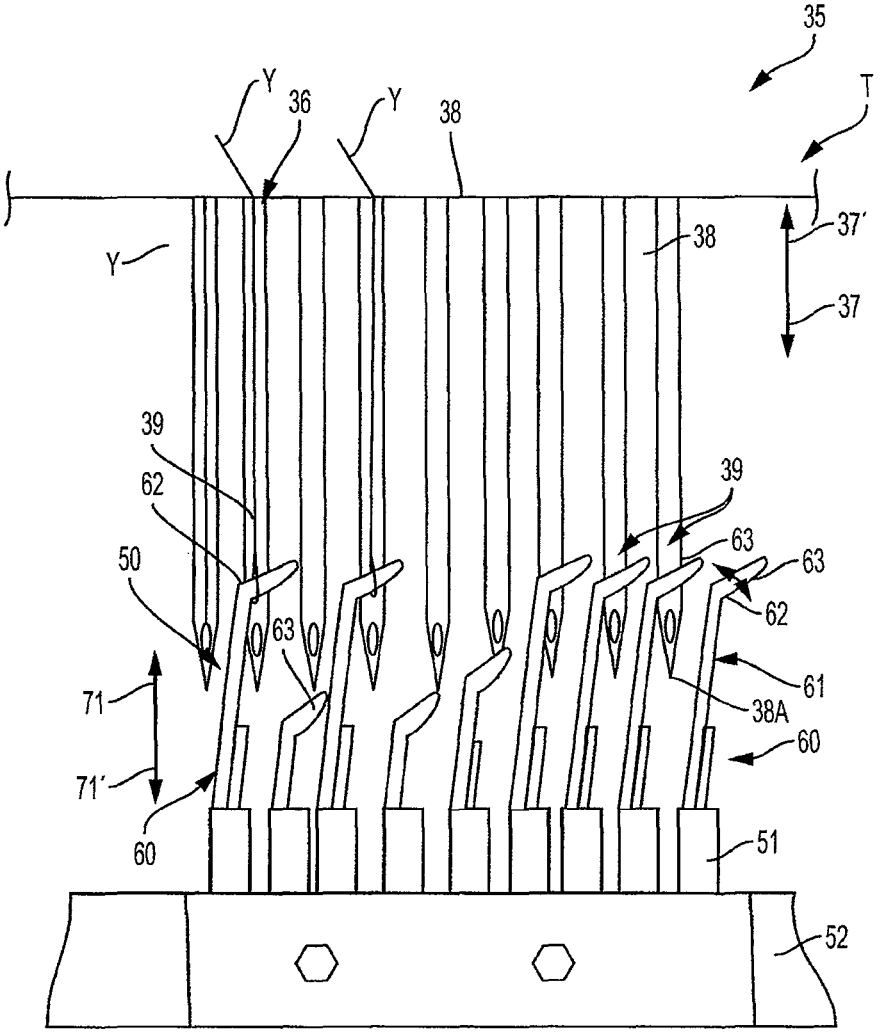
FIGS. 4A-4B are perspective views of a portion of a series of needles and their respective level cut loop loopers or hooks in accordance with one embodiment of the principles of the present invention.
Figure 4B:
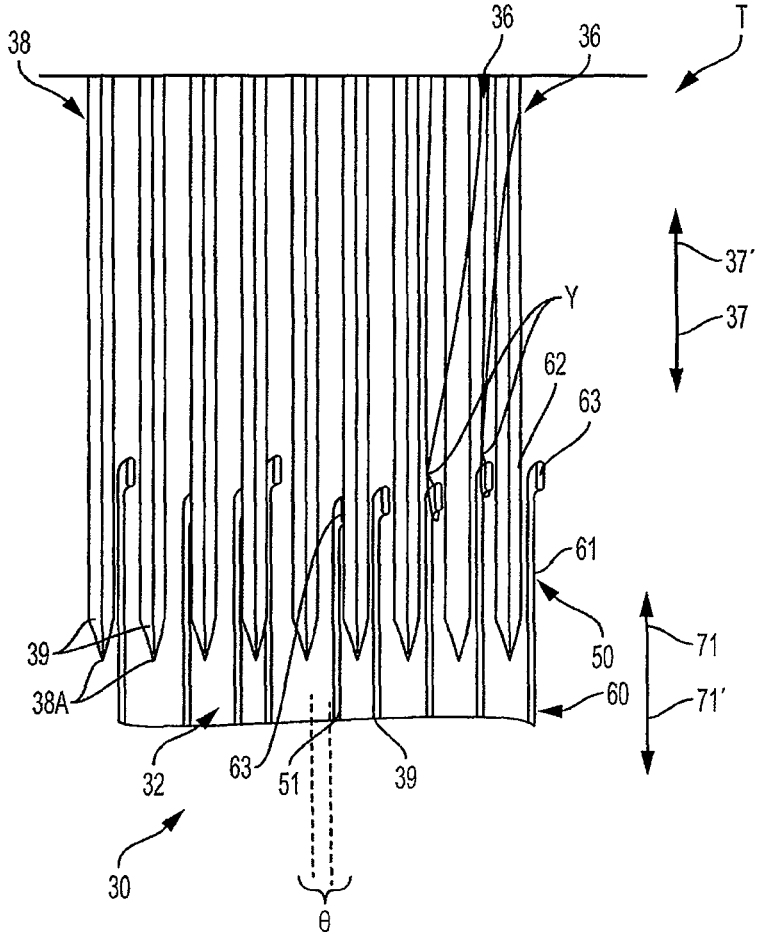
Figure 5C:
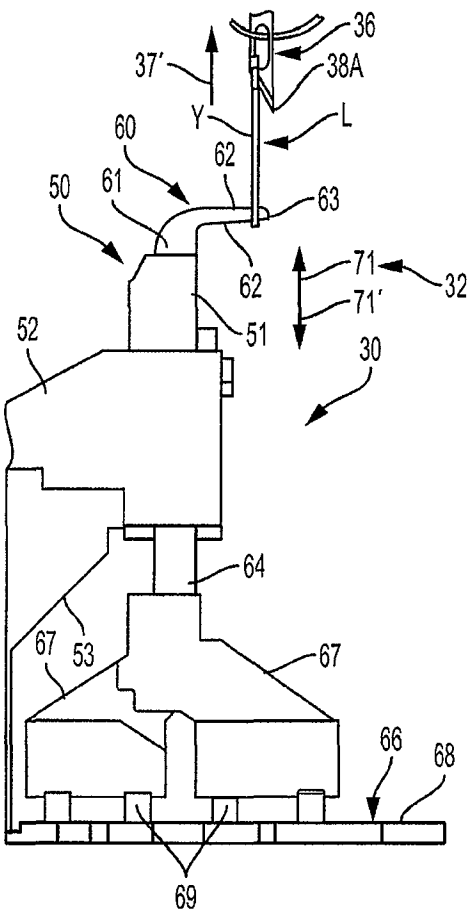
FIGS. 5A-5C are side elevational views illustrating the operation of the selectively actuatable level cut loop looper or hooks according to the principles of the present invention.
Figure 5B:
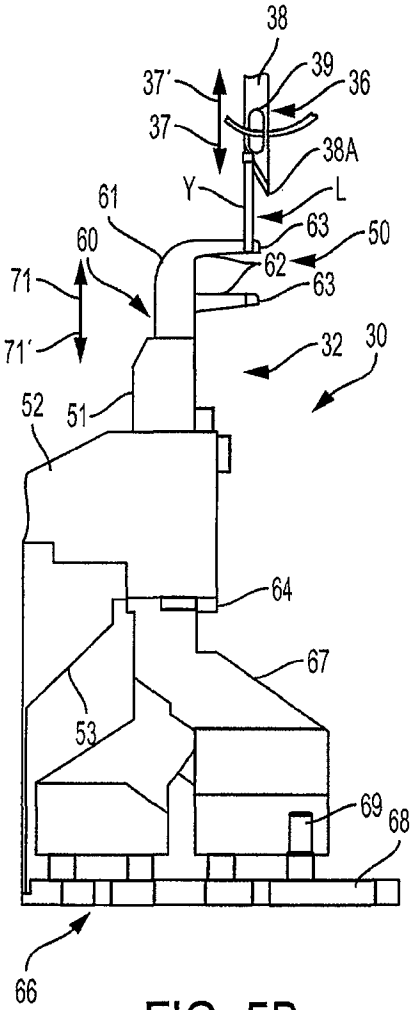
Figure 5A:
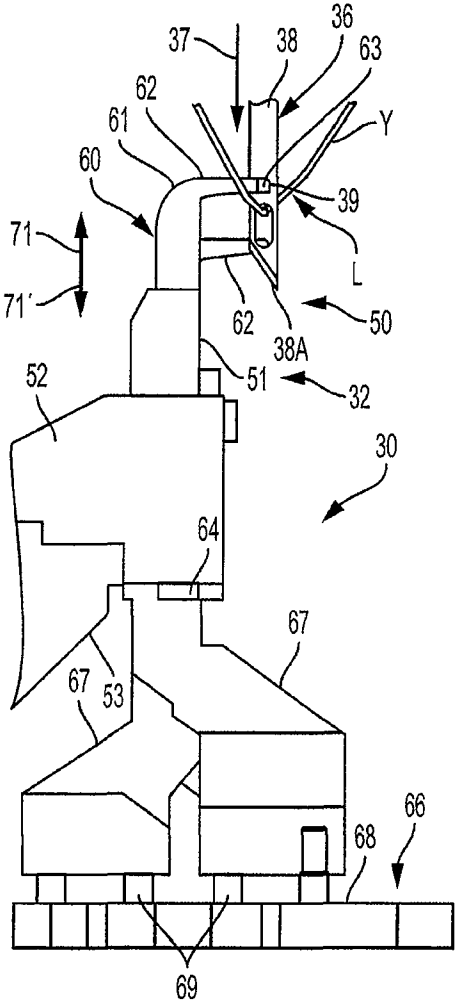

Each of the needles generally will include a shank or body 38 terminating at a pointed end 38A, and including a take-off point or area 39 where the gauge parts 32 can engage and pick-up yarns Y from the needles, such as indicated in FIGS. 4A-5A. As the needles are reciprocated in substantially vertical motion in the direction of arrows 37 and 37' (FIG. 2), they penetrate into and out of the backing material B along a stroke to a desired or predetermined penetration depth, carrying the yarns Y therewith, and will be selectively engaged by gauge parts 32 of the gauge part assembly 30, as shown in FIGS. 5A-5C to pick up loops L of the yarns from the needles. Additionally, as illustrated in FIG. 3, a shift mechanism 40 also can be linked to the needle bar 35 (or needle bars) where used for shifting the needle bar in the direction of arrows 41 and 41', transversely across the tufting zone according to calculated or computed pattern instructions. The shift mechanism 40 can include a Smart Step™ type shifter as manufactured by Card-Monroe Corp., or alternatively can include various other types of shift mechanisms including servo-motor or hydraulically controlled shifters, and/or pattern cam shifters as are conventionally used. Additional shift mechanisms including backing material or jute shifters, operable separately or in conjunction with a needle bar shifter for shifting the backing material laterally with respect to the needles also can be used.

As further illustrated in FIG. 1, one or more yarn feed mechanisms or attachments 27 can be mounted to the frame 11 of the tufting machine 10 for controlling the feeding of the yarns Y to each of the needles 36 during operation of the tufting machine. For example, as indicated in FIG. 3, a series of different type or color yarns (Y1-Y4) can be fed in a selected thread-up sequence or series (e.g., ABCD) to each of the needles, with the thread-up sequences generally being determined or selected based upon a pattern being run. Additionally, while one yarn feed unit 27 is shown along one side of the tufting machine 10 (for purposes of illustration), in other embodiments, multiple yarn feed units can be mounted on one or both sides of the tufting machine, for feeding yarns to the needles 36 of one or more needle bars 35.

There are a variety of yarn feed attachments that can be utilized with the stitch distribution control system of the present invention for controlling the feeding of the different yarns Y to various ones of the needles 36. The pattern yarn feed attachments or mechanisms 27 (FIG. 1) can comprise conventional yarn feed/drive mechanisms such as roll or scroll pattern attachments having a series of rolls extending at least partially along the tufting machine and driven by motors under direction of the control system 25 for controlling the feeding of the yarns across the tufting machine to form pattern repeats and/or multiple pile heights and/or other texture effects across the width of the backing material. Such yarn feed mechanisms or attachments can include Quick Thread™, Enhanced Graphics™, and/or Multi Pile Height Scroll yarn feed controls/attachments as manufactured by Card-Monroe Corp. Alternatively, other types of pattern yarn feed attachments can be used which have multiple yarn feed drives 45, as indicated in FIG. 1, each including a motor 46 and a feed roll 47, for controlling the feeding of specific sets of repeats of yarns to selected needles, including the use of individual yarn feed rolls or drives 45 for controlling the feeding of single yarns (or ends) or multiple ends of yarns (i.e., 2-4 or more yarns) to the needles 36, such as single and multi-end/servo-scroll attachments, including Infinity™ and Infinity IIE™ systems as manufactured by Card-Monroe Corp.

For example, U.S. Pat. Nos. 6,009,818; 5,983,815; 7,096,806, and 8,776,703 disclose pattern yarn feed mechanisms or attachments for controlling feeding or distribution of yarns to the needles of a tufting machine. U.S. Pat. No. 5,979,344 further discloses a precision drive system for driving various operative elements of the tufting machine, including for shifting the needle bar or needle bars. All of these systems can be utilized with the present invention and are incorporated herein by reference in their entireties. Thus, while in FIG. 1 a single or multiple end type yarn feed mechanism 27 is shown, it also will be understood by those skilled in the art that the pattern yarn feed mechanisms utilized to control the yarn feed can include single or double end yarn feed controls, scroll, roll, and/or similar attachments, and/or various combinations thereof, and further can be mounted along one or both sides of the tufting machine. Still further, the control system 25 can perform yarn feed compensation and/or yarn feed modeling to help control and reduce or minimize the amounts of non-retained/non-appearing yarns to be fed to avoid excess feeding of yarns and thus minimize waste during a tufting operation.

The yarn feed attachment can be controlled to selectively feed the yarns to their respective needles in cooperation with the other operative systems of the tufting machine, including the backing feed, shifting of the needle bars and the operation of the gauge part assembly 30, to enable control of the presentation of a number of different colors or types of yarns into the packing and the selective pick-up and retention of loops of selected or desired ones of the presented yarns (e.g., yarns selected to appear in the face of the finished patterned article) to form tufts of such yarns with selected or desired pile heights. In addition, the surface or face yarns or tufts that are to appear on the face of the tufted article can be controlled so as to be fed in amounts sufficient to form such tufts of the selected color or type yarns at desired or prescribed pile heights, while the non-appearing yarns that are to be hidden in particular color and/or texture fields of the pattern will be backrobbed and/or pulled substantially low or out of the backing material to an extent sufficient to avoid such yarns interfering with the face yarns or retained tufts that are to be visible in the pattern field, and to avoid creating an undesired space or gap between the retained tufts or face yarns. In one embodiment, each color or type yarn that can be placed/tufted at each pixel or stitch location generally either can be presented to such pixel or stitch location for tufting, with only the yarn(s) selected to be shown or appearing at the pixel or stitch location being retained and formed at a desired pile height. Thus, for a 4 color pattern, for example, each of the 4 color yarns A, B, C and D that can be tufted at a particular pixel or location can be presented to such pixel with only the selected yarn or yarns of the pattern, e.g., the "A" yarn, being retained, while the remaining, non-selected yarns, B, B-C, B-D, and/or other combinations, can be presented and back-robbed/pulled back and/or removed from the backing at such pixels or stitch locations. Accordingly, when a yarn is presented to a pixel or stitch location, if the yarn is to be retained or appear in the pixel or stitch location, the yarn feed 27 can be controlled to feed an amount of yarn so as to form a tuft of yarn at the pixel or stitch location. If the yarn presented is not to be retained or appearing in the pixel or stitch location, it can be controlled so that a loop or tuft may not be formed, or can be pulled back and/or removed. If no yarns are selected for insertion at a particular pixel or stitch location, the gauge parts also can be controlled to selectively pick-up or not pick-up loops of yarns presented to particular pixels.

As further shown in FIGS. 1-3, the gauge part assembly 30 generally is mounted below the bed 34 and tufting zone T of the tufting machine 10. As the needles penetrate the backing material, they are engaged by a series of gauge parts 32 of the gauge part assembly 30 so as to form loops L (FIGS. 2-3) of the yarns Y for forming tufts 5 of yarns of selected colors or types, and with selected lengths or pile heights. The gauge parts 32 of the gauge part assembly 30, in one embodiment, can include a series of level cut loop loopers or hooks 50, each of which can be slidably mounted within a module block or holder 51 that can be mounted to a gauge bar 52 or similar mount or attachment for attaching the level cut loop loopers or hooks 50 to the drive mechanism 53 which reciprocates the level cut loop loopers or hooks toward and away from the needles in the direction of arrows 54 and 54' as indicated in FIGS. 1-3. It further will be understood by those skilled in the art that various other types of gauge parts, including cut pile hooks, loop pile loopers, cut loop clips or other gauge parts also can be used.

As indicated in FIGS. 2, 4A-4B and 5A-5C, each of the level cut loop loopers or hooks 50 generally can include an elongated lower body or first portion 60 that can be slidably mounted within its module block or holder 51, and an upper, second or hook portion 61 including an elongated throat 62 that generally can extend at an angle with respect to the lower or body portion 60, and which can terminate at a generally pointed proximal end or bill 63. For example, the throat and proximal end can be configured similar to a loop pile looper. As further indicated in FIGS. 1, 2 and 5A-5C, a distal end 64 of the body of each level cut loop looper or hook generally will extend through its module block or holder, being slidable therethrough, and can be coupled to an actuator 66, such as by a gate or connector 67.

In one embodiment, as generally illustrated in FIGS. 2 and 5A-5C, the actuators can comprise hydraulic or pneumatic cylinders 68, each including a cylinder rod or shaft 69 that generally will be connected to an associated or corresponding one of the level cut loop loopers by a connector or gate 67. In some embodiments, the actuators further could be used to control operation of more than one level cut loop looper or hook. In addition, other types of actuators, including solenoids, motors, electric actuators or drives, or other, similar actuating mechanisms, as will be understood by those skilled in the art, also can be used. Each of the actuators generally will be linked to the control system 25, which will selectively control the actuation thereof so as to control the firing and/or movement of each of the level cut loop loopers with respect to the needles. The actuators will be controlled to selectively extend and retract their level cut loopers or hooks so that the position of their throats/bills can be varied in a direction generally normal to the reciprocation of the level cut loop loopers or hooks in the direction of arrows 54/54', and/or in a substantially vertical (i.e., a generally up and down) movement with respect to the needles, as illustrated by arrows 71 and 71' in FIGS. 2, 4A and 5A-5C, as the level cut loop loopers are reciprocated in the direction of arrows 54 and 54' toward and away from the needles 36. The actuators can be controlled to not only extend and retract the level cut loop loopers between extended and/or no-sew positions, but further can be selectively controlled so as to extend and/or retract the level cut loop loopers to a series of varying positions or elevations with respect to the stroke or depth of penetration of the needles. Thus, the position or location of the throats of the level cut loop loopers with respect to the needles can be controlled and varied so as to cause the pick-up and/or formation of loops of yarns from selected ones of the needles at varying pile heights or lengths, or no pick-up of yarns, such as indicated in FIGS. 5A-5C.

For example, in a fully extended position, selected ones of the level cut loop loopers or hooks can pick up loops of yarns from the needles engaged thereby, which loops generally can be formed with a first selected or desired pile height, whereas other ones of the level cut loop loopers can be extended or retracted to positions or locations between fully extended and retracted positions so as to pick up and form loops of yarns with second or other, differing lengths or pile heights. Some of the level cut loop loopers or hooks also can be moved to a fully lowered or retracted position by their actuators so as to place them in a no-sew position whereby the throats/bills of such level cut loop loopers or hooks are located below a full penetration depth or end of stroke of the needles and thus will not pick up loops of yarns from their corresponding or respective needles. In other operations, the actuators can be selectively controlled or triggered to retract or lower their respective level cut loop loopers after a loop of yarn has been captured thereon, so as to pull such captured loops of yarns lower, to elongate or create higher pile or increased length yarns for additional patterning effects, such as for tip shearing and/or other texturing effects.

As indicated in FIGS. 4A-4B, each of the level cut loop loopers or hooks 50 generally will be arranged at a prescribed spacing across the tufting zone, positioned so as to engage the needles, including being arranged in a substantially in-line, offset, staggered, and/or other configuration as needed depending upon the configurations of the needles of the needle bar or needle bars (for example, if the needles are arranged in an in-line, staggered and/or other arrangements along a single or dual needle bars). Each of the level cut loop loopers or hooks 50 further can be arranged at an angle or offset with respect to the needles penetrating the backing so as to move or be extensible/retractable along an angled path of travel 71/71' with respect to the needles and/or the take-off point thereof. Such an offset movement of the level cut loop loopers or hooks additionally can be varied as needed to minimize potential engagement of the level cut loop loopers or hooks by the needles as the loopers are being retracted, depending upon spacing and/or arrangement of needles.

For example, in some embodiments, the level cut loop loopers or hooks can be arranged and/or moved along a path of travel at an angle/offset, indicated at θ in FIG. 4B, that can range from approximately 1° to approximately 10° or more from the vertical and/or with respect to the stroke of the needles when the level cut loop loopers are retracted, and one example embodiment at an angle of approximately 4° to 6° with respect to the path or direction of reciprocation of the needles, as the needles complete their stroke or reciprocation into and out of the backing; while in other embodiments, substantially no offset, i.e., an approximately 0° angle with respect to the needles, can be provided between the level cut loop loopers and needles. Thus, as the level cut loop loopers are extended to positions/elevations sufficient to engage the take-off areas 39 (FIGS. 4A-5A) of the needles, the throats/bills thereof generally will be properly aligned or positioned to engage and pick-up loops of yarns from their corresponding needles. As the level cut loop loopers are retracted, they generally can further be moved along an offset path of travel so that their throats/bills can be placed or located at positions out of the path of travel of the needles to minimize potential inadvertent yarn pick-up when the level cut loop loopers are being moved to and/or are in retracted, no-sew positions.

Figure 6:
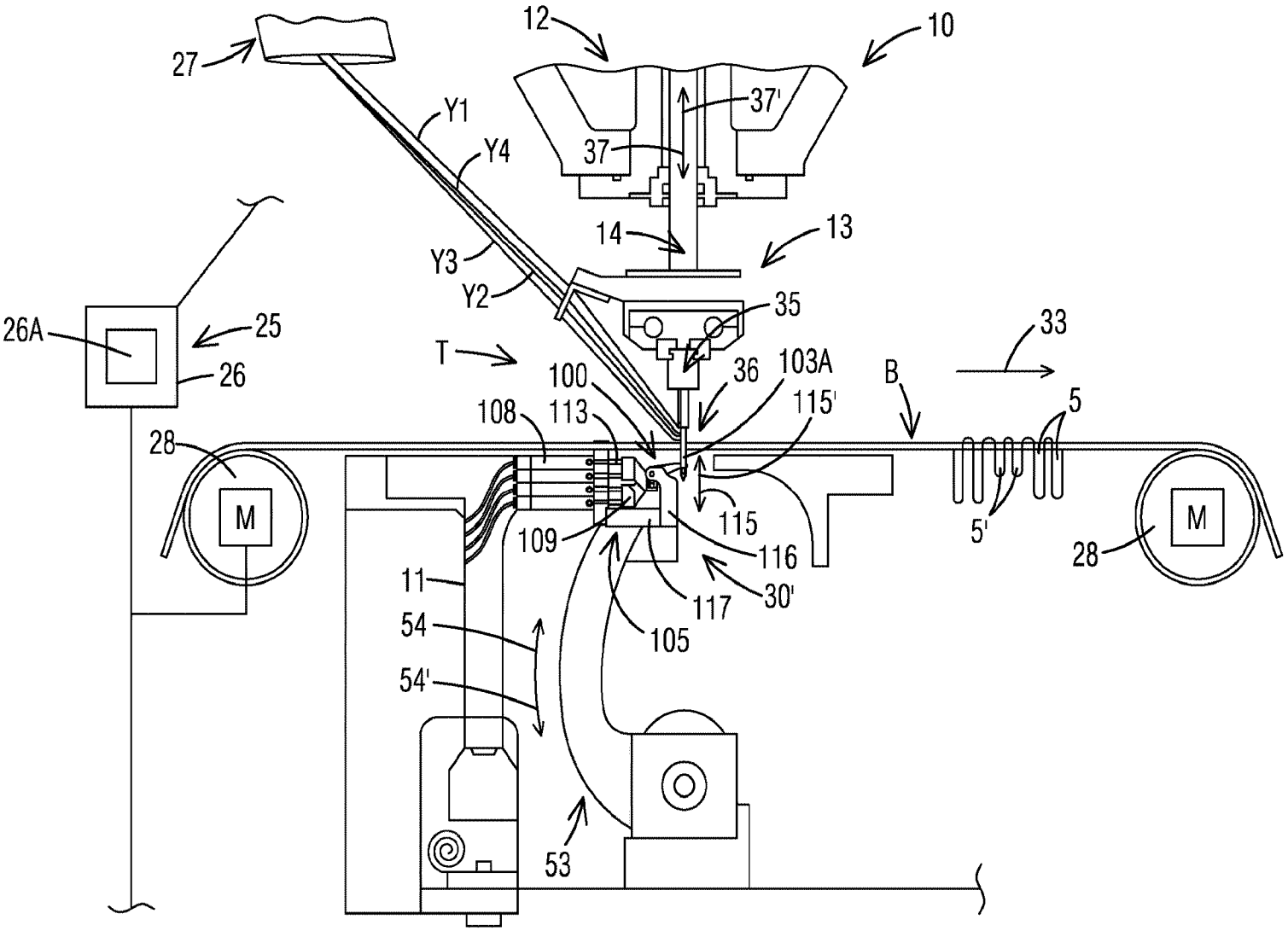
FIG. 6 is a side elevational view of an additional embodiment of the gauge part assembly according to the principles of the present invention.
Figure 7A:
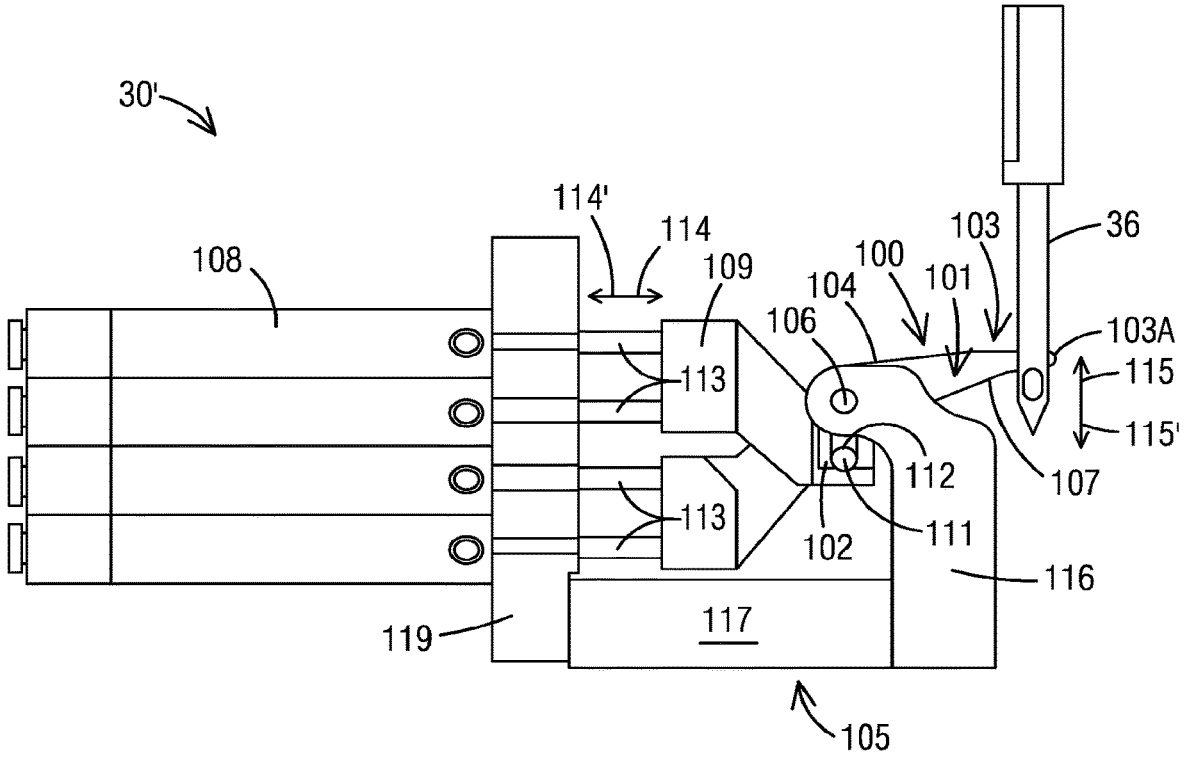
FIGS. 7A-7B are side elevational views illustrating the movement of the gauge parts of FIG. 6.
Figure 7B:
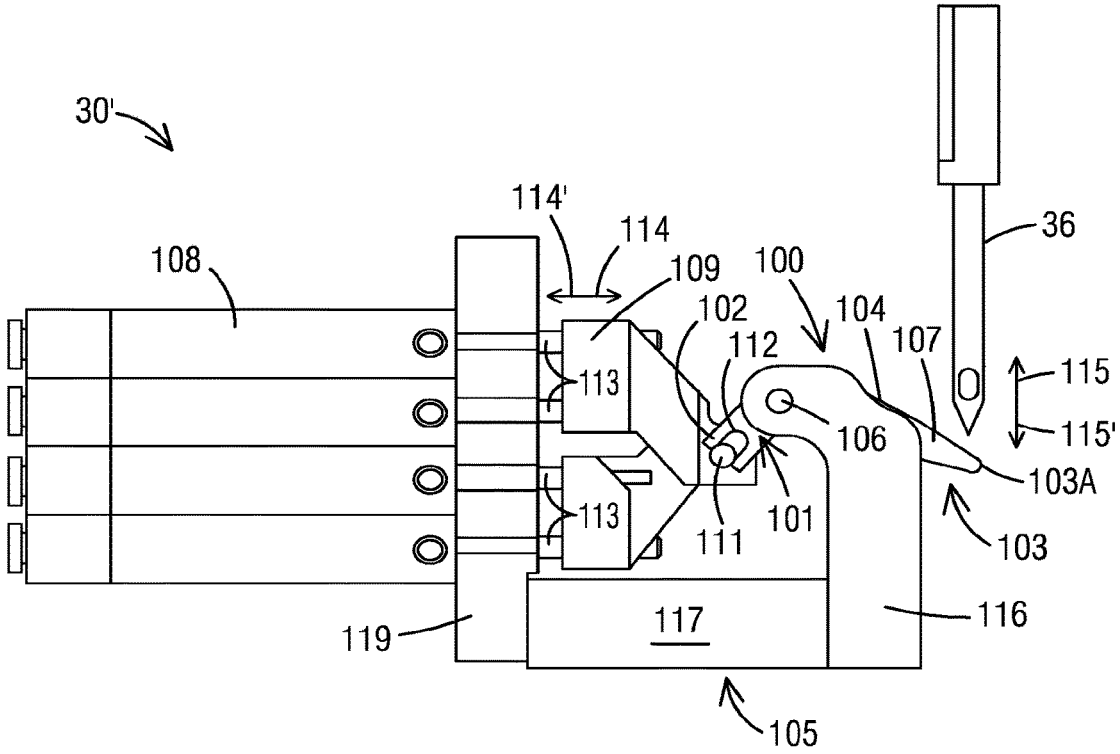

In another, alternative arrangement or embodiment, such as illustrated in FIGS. 6-7B, the gauge part assembly 30' can include a series of gauge parts 100, and can be mounted to the drive mechanism (FIG. 6), for reciprocation of the gauge parts 100 toward and away from the needles 36 in the direction of arrows 54/54'. In one aspect, as shown in FIGS. 7A-7B, the gauge parts 100 each can be formed or configured with an elongated body 101 having a first, proximal end 102, a second, distal end 103, which can be formed with a substantially pointed tip as indicated at 103A, and an intermediate portion 104 along which the body can be moveably or pivotally attached to a portion 116 of a holder or support 105 such as by a pin 106. A throat 107 is formed and extends forwardly from the intermediate portion 104 to the distal end 103.

The proximal ends 102 of the gauge part bodies 101 generally can be coupled to an actuator 108, such as hydraulic or pneumatic cylinders as shown in FIGS. 7A-7B. It will, however, be understood that other types of actuators, such as solenoids, motors, electric actuators or drives, etc., also can be used. In one example construction, the proximal ends 102 of the gauge part bodies 101 can engage and/or couple to a gate or connecting linkage 109, such as by a pin or projection 111 that can be received or engaged within a recess or opening 112 formed along the proximal end 102 of the gauge part body 101. The pin or projection 111 can comprise a removable fastener, rod or pin inserted into the body and the gate or linkage, or can be formed with or otherwise integrated with the gate or linkage 109.

Each of the actuators 100 generally can be selectively actuated or operated by the control system and will include a drive shaft or rod 113 that is extensible/retractable in the direction of arrows 114/114'. Upon actuation of one or more selected actuators, the rods 113 of such actuators will be extended or retracted as needed to cause the proximal ends 102 of their corresponding or associated gauge parts to be urged forward or rearward, in turn causing the bodies of such gauge parts to pivot or move about their connecting pins/projections 111. As a result, the distal ends 103 of the gauge parts are moved in the directions of arrows 115/115' between one or more operative positions for picking loops of yarns from needles 36, including a fully raised operative position as shown in FIG. 7A, and a fully lowered, no-sew position whereby the distal ends of the gauge parts are lowered or otherwise moved out of alignment with their associated needles so as to substantially avoid pickup of loops of yarns from their associated needles 36 as indicated in FIG. 7B.

As further illustrated in FIGS. 6-7B, the gauge parts 100 and actuators 108 of the gauge part assembly 30' generally will be mounted along a gauge bar or similar support/holder 105. In one aspect, the support/holder 105 can include a base 117 that is mounted or attached to an arm of the gauge assembly drive mechanism; with one or more upstanding supports or projections 116 mounted to the base 117 and generally having slots or spaces formed therein or therebetween, and/or in which the gauge parts 100 are received and pivotally mounted. A rearward support or block 119 can be mounted along the base 117 and can support the series of actuators 108 therealong, with the drive shafts or rods 113 of the actuators extensible therethrough, as indicated in FIGS. 7A-7B. The gates or connecting linkages 109 coupling the actuation drive shafts to the gauge parts can project at an angle, although it is also possible in some constructions to couple the gauge parts 100 substantially in-line with or directly to the actuator shafts 113. The drive mechanism 53 (FIG. 6) will generally reciprocate the gauge part assembly 30' in the direction of arrows 54/54' toward and away as the actuators 108 are selectively engaged/actuated to control positioning of the distal ends of the gauge parts with respect to their associated needles 36 as the needles reciprocated into and out of the backing material, to selectively pick up loops of yarns therefrom to form the patterned tufted article.

In operation, according to some embodiments, tufted articles can be formed according to the system and method of the present invention, which tufted articles can be formed with various patterns and pattern effects, including the use of multiple different color and/or type yarns for forming such patterns, as well as including sculptured or multiple pile height effects. For example, the system and method of the present invention can be operated in conjunction with a stitch distribution control system or yarn color placement system such as disclosed and illustrated in U.S. Pat. Nos. 8,141,505, 8,359,989 and 8,776,703, the disclosures of which are incorporated by reference as if set forth fully herein. In such embodiments, the stitches or tufts of yarns being formed in the backing material further can be formed at an increased or higher actual operative or effective process stitch rate as compared to the fabric or pattern stitch rate that is desired or prescribed for the tufted pattern being formed. Thus, if the pattern or fabric stitch rate or density of a pattern being formed calls for the tufted article to have an appearance of 8, 10, 12, etc., stitches per inch formed therein, and/or which are to be shown on its face, the actual, operative or effective number of stitches per inch formed during operation of the tufting machine will be substantially greater than the desired or prescribed pattern or fabric stitch rate. Thus, the actual formation of stitches or tufts of yarns in the backing material will be accomplished at an increased actual, operative or effective process stitch rate, whereby effectively, a greater number of stitches per inch than will be required to be shown in the finished pattern will be formed in the backing material, with those stitches or face yarns that are not desired to be shown or remaining in the face of the pattern field or area being sewn will not be formed, and/or will be back-robbed or pulled out of the backing material, or pulled sufficiently low to an extent to enable such yarns to be held or tacked in the backing while substantially avoiding creation of undesired or unnecessary gaps or spaces between the retained or face yarns of the pattern (i.e., the tufts of yarns that are to remain visible or appear in the finished pattern of the tufted article).

For purposes of illustration, in one example embodiment, the effective process stitch rate can be based upon or determined by increasing the fabric or pattern stitch rate of the pattern being formed approximately by a number of colors selected or being tufted in the pattern. For a pattern having a desired fabric or pattern stitch rate of about 10-12 stitches per inch, and which uses between 2-4 colors, the effective or operative process stitch rate (i.e., the rate at which stitches are actually formed in the backing material) can be approximately 18-20 stitches per inch up to approximately 40 or more stitches per inch. However, it further will be understood by those skilled in the art that additional variations of or adjustments to such an operative or effective process stitch rate run for a particular pattern can be made, depending upon yarn types and/or sizes and/or other factors. For example, if thicker, larger size or heavier yarns are used, the effective process stitch rate may be subject to additional variations as needed to account for the use of such larger yarns (e.g., for 4 color patterns, the effective process stitch rate can further vary, such as being run at about 25-38 stitches per inch, though further variations can be used as needed). Thus, where a selected or programmed pattern being run may be designed or desired to have ten to twelve stitches per inch as a desired pattern density or stitch rate therefor, the system may actually operate to form upwards of twenty to forty-eight or more stitches per inch, depending on the number of colors and/or types of yarns, even though visually, from the face of the finished tufted article, only the desired/selected ten to twelve stitches generally will appear.

Additionally, where a series of different colors are being tufted, the needles 36 of the needle bar 35 generally will be provided with a desired thread up, for example, for a four-color pattern an A, B, C, D thread up can be used for the needles. Alternatively, where 2 needle bars are used, the needles of each needle bar can be provided with alternating thread up sequences, i.e., an A/C thread up on the front needle bar, with the rear needle bar threaded with a B/D color thread up. In addition, the needles of such front and rear needle bars can be arranged in a staggered or offset alignment. The needle bar or needle bars further generally will be shifted by control of the needle bar shifter 40 (FIG. 2) in accordance with a shift profile for the pattern being formed, in conjunction with the control of the backing material and control of the yarn feed so as to effectively present each one of the colors (i.e., 2, 3, 4, 5, etc.) of yarns or each different type of yarn that could be sewn at a selected pattern pixel or tuft/stitch location to the corresponding gauge part by shifting of the needle bar transversely with respect to the backing material as the backing material is fed through the tufting zone.

For example, for a four color pattern, each of the one-four colors that can be sewn at a next pixel or stitch location, i.e., one, two, three, four, or no yarns can be presented at a selected pixel or stitch location, will be presented to a desired level cut loop looper or cut pile hook as the backing material is moved incrementally approximately ⅛th-1/40th of an inch per each shift motion or cam movement cycle. The gauge parts, e.g. level cut loop loopers or loop pile loopers, will engage and form loops of yarns, with a desired yarn or yarns being retained for forming a selected tuft, while the remaining yarns generally can be pulled low or back-robbed by control of the yarn feed mechanism(s), including pulling these non-retained yarns pulled out of the backing material so as to float along the backing material. Accordingly, each gauge part is given the ability to tuft any one, or potentially more than one (i.e., 2, 3, 4, 5, 6, etc.,) of the colors of the pattern, or possibly none of the colors presented to it, for each pattern pixel or tuft/stitch location associated therewith during each shift sequence and corresponding incremental movement of the backing material. As noted, if none of the different type or color yarns is to be tufted or placed at a particular tuft or stitch location or pixel, the yarn feed can be controlled to limit or otherwise control the yarns of the needles that could be presented at such stitch location or pixel to maintain selected yarns with their needles when no loop is to be picked up by a corresponding gauge part, and/or by substantially pulling back all of the yarns or otherwise preventing such yarns from being placed or appearing at that stitch location, and/or the needle bar additionally could be controlled so as to jump or otherwise bypass or skip presentation of the needles/yarns to that stitch location or pixel.

The feeding of the backing material B further can be controlled, i.e., by the stitch distribution control system in a variety of ways. For example, the tufting machine backing rolls 28 can be controlled to hold the backing material in place for a determined number of stitches or cycles of the needle bar, or can move the backing material at a desired number of stitches per inch, i.e., move about ¼th of an inch for each penetration, or variations thereof so as to move about $1/10^{th}$ of an inch as four stitches are introduced in the backing for a pattern with four colors and an effective stitch rate of 40 stitches per inch. The movement of the backing material further can be varied or manipulated on a stitch-by-stitch or pixel basis with the average movement of all the stitches over a cycle substantially matching the calculated incremental movement of the operative or effective process stitch rate. For example, for a 4-color cycle, a first stitch can be run at ⅛th of an inch, the next two at ¼th of an inch, and the fourth at ½th of an inch, with the average movement of the backing over the entire 4-stitch cycle averaging ¼th of an inch for each stitch presented, as needed, to achieve a desired stitch/color placement.

Each different yarn/color yarn that can be tufted at a particular stitch location or pixel thus can be presented to such stitch locations or pixels as the pattern is formed in the backing material. To accomplish such presentation of yarns at each pixel or stitch location, the needle bar(s) generally can be shifted as needed/desired per the calculated or selected cam profile or shift profile of the pattern to be run/formed, for example, using a combination of single and/or double jumps or shifts, based on the number of colors being run in the pattern and the area of the pattern field being formed by each specific color. Such a combination of single and double shift jumps or steps can be utilized to avoid over-tufting or engaging previously sewn tufts as the needle bar is shifted transversely and the backing material is advanced at its effective or operative stitch rate. The backing also can be shifted by backing or jute shifters, etc., either in conjunction with or separately from the needle bar shifting mechanism.

As the needles penetrate the backing B, as indicated in FIGS. 1 and 2, the gauge parts 32, e.g. level cut loop loopers 50, loop pile loopers, etc. of the gauge part assembly 30, will be reciprocated toward the needles, in the direction of arrow 54 so as to engage and pick or pull loops of yarns from their associated or corresponding needles. In addition, the actuators 66 for the level cut loop loopers can be selectively controlled and engaged so as to cause selected ones of the level cut loop loopers to be extended or retracted so that the bills 63 and throat portions 62 thereof are located at a desired position with respect to the needles as the needles 36 penetrate and complete their stroke into and out of the backing. As indicated in FIGS. 4-5C, the location or positioning of the bills and/or throat portions of the level cut loop loopers can be varied between a fully extended position or elevation and a lowered or retracted, "no-sew" position at which loops of yarns generally can be substantially prevented from being picked up and/or formed by such level cut loop loopers to provide a selective pick-up of loops of yarns, including no loop(s) of yarns being picked up, and control of the lengths of the loops of yarns that are selectively picked up from the yarns presented at each of the stitch locations or pixels in accordance with the instructions for the pattern being formed. As a result, the locations at which the loops of the selected or desired face yarns to be shown in the "finished" pattern are picked up from the needles by the level cut loop loopers can be controlled, with the formation of the resultant tufts from such picked up loops of yarns remaining within the backing further being controlled so as to be able to be formed at a variety of different pile heights.

The type/color of yarn of each series of yarns being presented at each pixel or stitch location that is to be retained or shown on the face of the backing at a particular stitch location generally will be determined according to the pattern instructions or programming for the formation of the tufted pattern. Controlling the activation and/or positioning of the throats of the level cut loop loopers 50 corresponding to or associated with the needles carrying such yarns can enable the tufting machine to selectively pick-up and retain a loop of that yarn at each stitch location at which such yarns are to remain in accordance with the pattern, so as to form a resultant tuft of such a yarn at a selected pile height. For example, if the presented yarn is not to be shown or appear, the corresponding level cut loop looper can be retracted to a no-sew position so that a loop of yarn is not picked-up, and the yarn feed therefor controlled so that such a loop of yarn is not formed or retained at the pixel or stitch location. For example, such yarns can be controlled by the yarn feed to maintain the yarns with their needles as their needles are reciprocated into and out of the backing without being engaged by a corresponding gauge part. Maintaining the yarns with their needles when no loops of such yarns are picked up further can help protect the yarns and minimize twisting or kinking thereof, enabling the yarns to have a straighter alignment along the back-side of the backing material. For the retained yarns/colors, i.e., the yarns appearing on the face of the patterned tufted article, the positions or elevations of the level cut loop loopers and the yarn feed mechanisms feeding these yarns generally can be cooperatively controlled so as to enable pick-up and formation of loops of such yarns, and movement of the level cut loop loopers to varying elevations sufficient to form tufts of a desired type and pile height.

Alternatively, with a gauge part assembly 30', such as illustrated in FIGS. 6-7B, the actuators 108 can be selectively engaged or operated as the gauge part assembly 30' is reciprocated in the direction of arrows 54/54' (FIG. 6) toward and away from engagement with the needles 36, so as to cause the corresponding gauge parts 100 to be moved between operative and no-sew or non-engaging positions as illustrated in FIGS. 7A-7B. In their raised, operative positions, the gauge parts 100 will engage associated ones of the needles to selectively pick-up and retain a loop of the color or type of yarn of the series of yarns presented/carried by such needles as needed, selected or desired to remain/be retained at a stich location in accordance with the pattern being tufted, to form a tuft of such yarns at selected or desired pile height. If the presented yarn is not to be shown or appear in the face of the tufted pattern, the corresponding gauge part 100 can be retracted or lowered to its no-sew position (FIG. 7B) so that a loop of yarn is not picked-up. For example, as indicated in FIG. 7B, the throats and distal ends of the gauge parts can be reoriented so as to extend at a downward sloping angle, or can be otherwise oriented, so as to avoid engaging the needles as the gauge parts are reciprocated toward the needles. The yarn feed for those yarns/needles where a loop of yarn is not to be formed/retained further can be controlled so that the yarn can be carried in and out of the backing material with its needle, but generally without a loop of such yarn being formed or retained at the pixel or stitch location. For the retained loops of yarns, i.e., the color or type yarns that are to be shown or appear on the face of the patterned tufted article based on the pattern, the positions or elevations of the gauge parts, and the yarn feed mechanisms feeding these yarns generally can be cooperatively controlled so as to enable pick-up and formation of loops of such yarns sufficient to form tufts of a desired yarn color or type and at a selected pile height, e.g. after picking up loops of yarns, selected gauge parts can be controlled to move or re-position their throats at a different elevation, in cooperation with the yarn feed control, to form different length (i.e. longer or shorter) loops as needed or desired for forming additional pattern effects, such as tip-shearing or sculptured pattern effects.

The further control of the backing feed at an increased effective or operative process stitch rate (e.g., the actual rate at which stitches are formed in the backing) in accordance with the principles of the present invention further provides for a denser or compressed field of stitches or tufts per inch, so that the yarns being back-robbed are removed or pulsed low to an extent sufficient to avoid creation of undesired spaces or gaps between the retained face yarns (those appearing on the face of the tufted article according to the pattern) or interfering with or showing through such retained face yarns formed in the backing material. Additionally, the control system can perform yarn feed compensation and/or modeling of the yarn feed to help control and reduce the amount of non-retained or non-appearing yarns that may be "floating" on the back side of the backing material to further help reduce/minimize excess yarn feed and/or waste.

In addition, the yarn feed mechanisms controlling the feeding of each of the yarns to each of the needles can be selectively controlled to back-rob or pull the yarns carried by the needles substantially out of the backing material or with the reciprocation of the needles; and can retract or pull back/low some loops of yarns to a position substantially low enough to generally avoid such non-selected ends of yarns occupying a selected stitch location, or otherwise interfering with the placement of a selected face yarn or yarn to be shown in a particular color field being formed according to the pattern. For example, where particular gauge parts are retracted to a fully retracted position or "no sew" position, no loop generally will be picked up from the needles associated with such fully retracted gauge parts, the yarn feed is correspondingly controlled so that the yarns are allowed to move with their needles into and back out of the backing material. Thus, the yarns can be maintained with and protected by their needles, moving into and out of the backing material in a generally straighter motion with the reciprocation of their needles, which can further help avoid kinking or undesired twisting of the yarns. In addition, in some instances where loops of yarns are formed, such as when the gauge parts are at a fully extended position and form low loops, the resultant formed loops of yarns further can be back-robbed or pulled substantially low or out of the backing material by control of the yarn feed thereof to an extent so as to leave an amount of yarn engaged with or "tacked" to the backing, while substantially removing such yarns to an extent so that such non-selected ends of yarns generally will not interfere with the placement of a face appearing or selected yarn at a particular stitch location within the color field being sewn.

The placement of the non-appearing yarns being tacked or otherwise secured to the backing material also can be controlled to prevent the formation of such extended length tails that can later become caught or cause other defects in the finished tufted article. For example, the control system also can be programmed/set to tack or form low stitches of such non-appearing yarns at desired intervals, e.g., every 1 inch to 1.5 inches, although greater or lesser intervals also can be used. Yarn compensation also generally can be used to help ensure that a sufficient amount of yarns are fed when needed to enable the non-appearing yarns to be tacked into the backing material, while preventing the yarns from showing or bubbling up through another color, i.e., with the yarns being tacked into and projecting through one of the stitch yarns with several yarns being placed together. Additionally, where extended lengths or tails would be formed for multiple non-appearing yarns, the intervals at which such different yarns are tacked within the backing material can be varied (i.e., one at 1", another at 1.5", etc.,) so as to avoid such tacked yarns interfering with one another and/or the yarns of the color field being formed.

Still further, the actuators 66/108 for the gauge parts 32/100 also can be controlled, in conjunction with the control of the yarn feed mechanisms, to cause the formation of extended or elongated loops of yarns, such as by being engaged and retracting or lowering their respective gauge parts 32/100 with a loop of yarn captured thereon. The captured loops of yarns thus can be further pulled and/or elongated, while the corresponding yarn feed also can be controlled for feeding of additional amounts of such yarns. As a result, even longer or greater length loops of yarns can be formed in the backing so as to create higher pile tufts and/or for creating other desired pattern effects, such as for tip shearing and/or other patterning features. The selective control of the actuators for selectively retracting and extending or pivoting their gauge parts further can be used to provide additional variation or transitioning steps or pile heights within a pattern, for example, being controlled as needed to provide more gradual or subtle differences or changes in pile heights, or for providing more dramatic or defined separations between pile heights of the tufts of yarns being formed.

Accordingly, across the width of the tufting machine, the control system will control the shifting and feeding of the yarns of each color or desired pattern texture effect so that each color that can or may be sewn at a particular tuft location or pattern pixel will be presented within that pattern pixel space or tuft location for sewing, but only the selected yarn tufts for a particular color or pattern texture effect will remain in that tuft/stitch location or pattern pixel. As further noted, it is also possible to present additional or more colors to each of the gauge parts/loopers during a tufting step in order to form mixed color tufts or to provide a tweed effect as desired, wherein two or more stitches or yarn will be placed at desire pattern pixel or tuft location. The results of the operation of the stitch distribution control system accordingly provide a multi-color visual effect of pattern color or texture effects that are selectively placed in order to get the desired density and pattern appearance for the finished tufted article. This further enables the creation of a wider variety of geometric, free flowing and other pattern effects by control of the placement of the tufts or yarns at selected pattern pixels or tuft locations.

The system and method for tufting sculptured and multiple pile height patterns articles of the present invention thus can enable an operator to develop and run a variety of tufted patterns having a variety of looks, textures, etc., at the tufting machine without necessarily having to utilize a design center to draw out and create the pattern. Instead, with the present invention, in addition to and/or as an alternative to manually preparing patterns or using a design center, the operator can scan an image (i.e., a photograph, drawing, jpeg, etc.,) or upload a designed pattern file at the tufting machine and the stitch distribution control system can read the image and develop the program steps or parameters to thereafter control the tufting machine substantially without further operator input or control necessarily required to form the desired tufted patterned article.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed:

1. A tufting machine, comprising:

at least one needle bar having a plurality of needles mounted therealong;

backing feed rolls feeding a backing material along a path of travel;

at least one yarn feed mechanism feeding yarns to the needles;

a plurality of gauge parts adjacent the backing material each including a body having a throat;

wherein the gauge parts are movable in one direction toward and away from the needles as the needles are reciprocated into the backing material for pick-up of loops of yarns therefrom, and in an additional direction with respect to the needles between raised and lowered positions; and a control system including programming for controlling feeding of the yarns to the needles in coordination with movement of selected ones of the gauge parts in the additional direction such that the throats of the gauge parts are moved to their raised or lowered positions with respect to the needles as the needles are reciprocated into the backing material so as to selectively pick-up loops of yarns from the needles.

2. The tufting machine of claim 1, further comprising a shift mechanism for shifting the at least one needle bar across the backing material; and wherein the control system further comprises programming to coordinate shifting of the at least one needle bar, feeding of the backing material, movement of the gauge parts in the additional direction, and feeding of the yarns to the needles as the needles are reciprocated into and out of the backing, wherein a series of yarns are presented to each of a plurality of stitch locations along the backing material and where loops of non-selected yarns are not picked up by one of the gauge parts, the non-selected yarns are pulled low or substantially withdrawn from the backing material.

3. The tufting machine of claim 2, wherein the control system controls the feeding to the backing material at an operative stitch rate that is greater than a pattern stitch rate for a tufted pattern being formed.

4. The tufting machine of claim 1, wherein the gauge parts comprise loop pile loopers, level cut loop loopers, or cut pile hooks.

5. The tufting machine of claim 1, wherein the body of each gauge part is pivotally mounted to a support, and wherein movement of the selected ones of the gauge parts in the additional direction causes the throats thereof to be pivoted between a lowered no-sew position sufficient to avoid picking-up of yarns from the needles, and a raised position wherein as the gauge parts are reciprocated into engagement with the needles, the loops of yarns are picked-up from the needles by the gauge parts.

6. The tufting machine of claim 1, wherein the yarn feed mechanism comprises at least one of a scroll, roll, single end, double end, or multiple end yarn feed pattern attachment.

7. The tufting machine of claim 1, wherein the at least one needle bar comprises a pair of needle bars each having a series of needles mounted in spaced series therealong.

8. A method of forming a patterned tufted article comprising:

moving a backing along a path of travel and reciprocating the needles into and out of the backing;

feeding yarns to the needles as the needles are reciprocated into the backing;

reciprocating a series of gauge parts in a direction toward the needles for picking loops of yarns from the needles, and selectively moving at least some of the gauge parts in an additional, a substantially vertical direction;

presenting at least some of the yarns to a plurality of stitch locations;

if a loop of a non-selected yarn of the yarns presented at a selected stitch location is not to be picked-up by a gauge part, moving the gauge part in the additional direction so as to lower the throat thereof toward a position sufficient to avoid pick-up of the loop of the non-selected yarn, and controlling feeding of the non-selected yarn so as to substantially withdraw the non-selected yarn from the backing as the needles are reciprocated out of the backing; and wherein if a loop of a selected yarn of the yarns presented to the selected stitch location is to be retained, moving the gauge part in the additional direction to move the throat thereof to a raised position sufficient to pick-up the loop of the selected yarn, and controlling the feeding of the selected yarn to form a loop of yarn of a desired length.

9. The method of claim 8 wherein moving the gauge part in the additional direction comprises controlling an actuator coupled to the gauge part to raise or lower the throat portion of the gauge part with respect to the needles.

10. The method of claim 8, wherein moving the gauge parts comprises pivoting the bodies of the gauge parts to reorient the throat portions thereof with respect to the needles.

11. The method of claim 8, further comprising threading the needles with a series of different color or type yarns in a selected threading sequence.

12. The method of claim 8, wherein moving the backing along its path of travel comprises feeding the backing at an actual stitch rate determined by increasing a desired stitch rate of a pattern being formed approximately by a number of different color or type yarns in the selected thread sequence.

13. A method of forming carpets, comprising:

threading a plurality of needles with a plurality of yarns in a thread-up sequence;

feeding a backing material past the needles and reciprocating the needles into and out of the backing material;

as the needles are reciprocated into and out of the backing material, feeding a plurality of yarns to the needles and reciprocating a series of gauge parts arranged below the backing material in a direction of reciprocation toward and away from engagement with the needles for picking-up loops of yarns from the needles with at least some of the gauge parts;

if loops of non-selected yarns are not to be picked-up, moving selected ones of the gauge parts in an additional direction so that throat portions of the gauge parts are moved in an additional direction with respect to the needles, the additional direction being different from the direction of reciprocation of the gauge parts, to locate throat portions of the gauge parts in a lowered position sufficient to substantially avoid picking-up the loops of the non-selected yarns; and controlling the feeding of the yarns to cause the non-selected yarns to be substantially withdrawn from the backing material, and to control a length of each of the loops of yarns picked-up for forming tufts of desired pile heights in the backing material.

14. The method of claim 13, further comprising shifting at least some of the needles transversely with respect to the backing material so as to present a series of yarns to each of a plurality of stitch locations, and wherein feeding the backing material comprises moving the backing material at an actual stitch rate determined by increasing a desired stitch rate for the patterned article by a number of yarns in the selected thread-up sequence.

15. The method of claim 13, wherein moving the selected ones of the gauge parts in the additional direction comprises engaging a series of actuators associated with the selected ones of the gauge parts, and pivoting the throat portions of the selected ones of the gauge parts so as to re-position the throat portions of the selected ones of the gauge parts to their lowered positions.

16. The method of claim 15, wherein if at least one yarn is to be picked-up, by pivoting the gauge parts so as to positon the throat portions thereof between one or more extended positions for picking up loops of yarns.

17. A tufting machine, comprising:

at least one needle bar carrying a series of needles;

a backing feed for feeding of a backing through the tufting machine;

at least one yarn feed mechanism feeding yarns to the needles;

a shift mechanism for shifting at least one needle bar transversely across the backing material;

gauge parts arranged below the backing material and each having a body with a throat at one end thereof;

wherein the gauge parts are moveable in a direction of reciprocation toward and away from engagement with the needles to pick-up loops of yarns from the needles along the throats of the gauge parts as the needles are reciprocated into the backing, and in an additional direction that is different from the direction of reciprocation of the gauge parts;

actuators coupled to the gauge parts and configured to move the gauge parts in the additional direction; and a control system including programming for controlling the actuators to move selected gauge parts in the additional direction so as to locate the throats of the gauge parts between at least one raised position for capturing loops of yarns therealong and a lowered positon with respect to a stroke of the needles at which lowered position the selected gauge parts will substantially avoid pick-up of loops of yarn, and for cooperatively controlling the at least one yarn feed mechanism to control the yarns to the needles sufficient to form tufts of yarns in the backing at one or more desired pile heights or pull non-selected yarns substantially low or out of the backing.

18. The tufting machine of claim 17, wherein the body of each gauge part is pivotally mounted within a holder and is coupled to a corresponding one of the actuators, and wherein the throats of the gauge parts extend at an angle with respect to their body portions and substantially in the direction of reciprocation of the gauge parts.

19. The tufting machine of claim 17, wherein the control system further comprises programming to coordinate shifting of the at least one needle bar by the shift mechanism, feeding of the backing material by the backing feed rolls, control of the yarn feed mechanism feeding the yarns to the needles as the needles are reciprocated into and out of the backing, and control of the actuators to move the throats of the gauge parts between their raised and lowered positions; wherein a series of yarns are presented to stitch locations along the backing material, and non-selected yarns that are presented to the stitch locations are not to be picked-up by one of the gauge parts, the throats of the gauge parts corresponding to such stitch locations are moved to their lowered position and the non-selected yarns are pulled substantially low or out of the backing material, while the backing material is fed through the tufting zone at an operative stitch rate that is greater than a pattern stitch rate for the pattern being formed to provide a number of retained tufts per inch of face yarns in the backing material approximately equivalent to the pattern stitch rate.

20. The tufting machine of claim 17, wherein the gauge parts comprise loop pile loopers, level cut loop loopers, or cut pile hooks.

* * * * *